US012428841B2

(12) United States Patent
Hill et al.

(10) Patent No.: US 12,428,841 B2
(45) Date of Patent: Sep. 30, 2025

(54) BALCONY DEVELOPMENTS

(71) Applicant: SAPPHIRE BALCONIES LIMITED, Reading (GB)

(72) Inventors: Tim Hill, Reading (GB); Karl Pallister, Reading (GB); Andrew Parsons, Reading (GB)

(73) Assignee: SAPPHIRE BALCONIES LIMITED, Reading (GB)

( * ) Notice: Subject to any disclaimer, the term of this patent is extended or adjusted under 35 U.S.C. 154(b) by 0 days.

(21) Appl. No.: 18/041,521

(22) PCT Filed: Nov. 5, 2021

(86) PCT No.: PCT/EP2021/080836

§ 371 (c)(1),
(2) Date: Feb. 13, 2023

(87) PCT Pub. No.: WO2022/096684

PCT Pub. Date: May 12, 2022

(65) Prior Publication Data

US 2023/0304288 A1 Sep. 28, 2023

(30) Foreign Application Priority Data

Nov. 9, 2020 (GB) ..... 2017645
Nov. 9, 2020 (GB) ..... 2017647
(Continued)

(51) Int. Cl.
*E04C 3/07* (2006.01)
*E04B 1/00* (2006.01)
(Continued)

(52) U.S. Cl.
CPC ..... *E04C 3/07* (2013.01); *E04B 1/003* (2013.01); *E04B 1/388* (2023.08); *E04C 2003/0482* (2013.01)

(58) Field of Classification Search
CPC ..... E04C 3/07; E04C 2003/0482; E04C 2003/0465; E04B 1/388; E04B 1/003; E04B 1/0038
See application file for complete search history.

(56) References Cited

U.S. PATENT DOCUMENTS 2,026,278 A * 12/1935 Higley ..... E04B 5/10 52/579
3,999,346 A * 12/1976 Fetherston ..... E04B 5/10 52/669
(Continued)

FOREIGN PATENT DOCUMENTS

CN 204401804 U 6/2015
CN 111636553 A 9/2020
(Continued)

OTHER PUBLICATIONS

UKIPO Search Report, Application No. GB-2017645.9, dated Apr. 20, 2021, 3 pages.
(Continued)

*Primary Examiner* — Patrick J Maestri
(74) *Attorney, Agent, or Firm* — Quarles & Brady LLP

(57) ABSTRACT

A balcony is attachable to an attachment beam extending from a building in order to attach the balcony with respect to the building. The balcony can include: a floor which provides a safe, usable surface for the end-user of the balcony to stand on; and a plurality of rafters. Each rafter can include: a floor portion which defines a part of the floor, and a strengthening portion which is located below the floor portion and extends downwardly from the floor portion. The floor portions of the rafters cooperate to define the floor. Each of the plurality of rafters is an integrally formed component.

16 Claims, 17 Drawing Sheets

(30) Foreign Application Priority Data

| | | |
|---|---|---|
| Nov. 9, 2020 | (GB) | 2017650 |
| Nov. 9, 2020 | (GB) | 2017655 |
| Nov. 9, 2020 | (GB) | 2017660 |

(51) Int. Cl.

| | |
|---|---|
| *E04B 1/38* | (2006.01) |
| *E04C 3/04* | (2006.01) |

(56) References Cited

U.S. PATENT DOCUMENTS

| | | | | |
|---|---|---|---|---|
| 4,194,330 | A * | 3/1980 | Smith | B62D 25/2054 52/177 |
| 4,288,957 | A * | 9/1981 | Meehan | B62D 25/2054 52/471 |
| 11,025,191 | B2 * | 6/2021 | Priefert | H02S 20/00 |
| 2016/0053475 | A1 * | 2/2016 | Locker | E04C 3/28 52/73 |

FOREIGN PATENT DOCUMENTS

| | | | |
|---|---|---|---|
| DE | 29722108 | U1 | 12/1997 |
| EP | 2075392 | A1 | 12/2007 |
| EP | 2261430 | A2 | 12/2010 |
| GB | 2514164 | A | 11/2014 |
| GB | 2558272 | A | 7/2018 |
| WO | WO-2013/122478 | A1 | 8/2013 |
| WO | WO-2016/178016 | A1 | 11/2016 |
| WO | WO-2019/006447 | A1 | 1/2019 |

OTHER PUBLICATIONS

UKIPO Search Report, Application No. GB-2017660.8, dated Apr. 29, 2021, 3 pages.
UKIPO Search Report, Application No. GB-2017655.8, dated Apr. 29, 2021, 3 pages.
UKIPO Search Report, Application No. GB-2017650.9, dated Apr. 29, 2021, 3 pages.
UKIPO Search Report, Application No. GB-2017647.5, dated Apr. 29, 2021, 3 pages.
International Search Report & Written Opinion, International Application No. PCT/EP2021/080836, dated Mar. 1, 2022.

* cited by examiner

BALCONY DEVELOPMENTS

RELATED APPLICATIONS

This application is a 35 U.S.C. § 371 national phase application of PCT/EP2021/080836 (WO 2022/096684 A1), filed on Nov. 5, 2021, entitled "BALCONY DEVELOPMENTS" which claims priority to GB-2017660.8; GB-2017645.9; GB-2017647.5; GB 2017650.9; and GB-2017655.8 all filed on Nov. 9, 2020, which are incorporated herein by reference in their entirety.

FIELD OF THE INVENTION

The present invention relates to developments in the field of balconies for buildings.

BACKGROUND

It is known to provide a balcony for a building in the form of a balcony cassette. The building is first constructed, typically leaving balcony attachment stubs or beams protruding from the exterior of the building, which are used to mount balcony cassettes. Subsequently, balcony cassettes, assembled off-site, are lifted into position, supported on and secured to the attachment beams. The balcony cassettes typically have an arrangement of beams, joists or rafters which provide support for a balustrade, decking and other components of the balcony. The balustrade and decking provide the balcony with its external appearance.

The attachment beams may be cantilevered from the building. The balcony cassettes are provided with one or more attachment beam receiving apertures, usually at the back of the balcony. The attachment beam receiving apertures correspond to respective attachment beams on the building so that the attachment beams can be passed through the attachment beam receiving apertures and pass into respective voids in the beams, joists or rafters which make up the structure of the balcony. To secure the balcony to the one or more attachment beams, one or more clamping mechanisms are used. For example, two clamping mechanisms may be used to attach the balcony to each attachment beam, one close to the building and one further away from the building. As well as securing the balcony cassette to the attachment beams, the clamping mechanisms can be adjusted to ensure the balcony is level relative to the building. The clamping mechanisms may be adjusted using adjusters to ensure a secure attachment to the building.

The clamping mechanisms are usually located below a floor of the balcony which is formed by the decking, usually attached to rafters which support the decking and the balustrade. In order to gain access to the clamping mechanisms and to adjust them so that the balcony cassette is secured to the building, it is necessary to lift up some of the decking. However, lifting the decking creates large holes or gaps in the floor of the balcony. Installation workers must stand on the decking or exposed rafters to adjust the clamping mechanisms and complete the balcony installation by adjusting the clamping mechanisms to secure the balcony to the attachment beam. Large holes and gaps put installation workers at risk of injury. Further, tools or debris from the installation process may fall through the large holes or gaps. This can be dangerous for construction workers on the ground, particularly as balconies may be installed far from the ground. Moreover, removing decking adds time to the installation process, which can increase the cost of building projects where many balconies must be installed.

It is normal to use lifting equipment (e.g. a crane) to locate each balcony cassette in turn on a building and to support each balcony cassette whilst it is being secured to the attachment beam(s) (which may be performed by installation workers standing on the balcony). Therefore, lifting points may need to be installed on a balcony cassette for the lifting equipment so that it can be safely attached to the balcony cassette without causing damage. Lifting points are usually located on hidden structural parts of the balcony cassettes such as on rafters underneath the decking. Access to these lifting points is usually achieved by lifting the decking. This also results in large holes or gaps in the floor of the balcony and leads to similar problems to those described above.

When installing a balcony, it is important to ensure that the floor of the balcony aligns with the internal floor of the building. This is dependent on the location of the attachment beam relative to the building and the spacing between the floor of the balcony and the top of the attachment beam. This allows easy wheelchair access to the balcony. Known cassette balconies, of the type manufactured and installed by the applicant, may make use of clamping mechanisms having clamping jaws which respectively engage with the upper and lower surfaces of the attachment beam, so that the attachment beam is interposed between the clamping jaws. An example type of clamping mechanism is shown in WO 2016/178016. Therefore, when the cassette balcony is attached to the building, the minimum spacing between the floor of the balcony and the upper surface of the attachment beam is defined in part by the thickness of a clamping jaw of the clamping mechanism. This means that the attachment beam should not be spaced too closely to the internal floor of the building, otherwise the floor of the balcony and the floor of the building may not be aligned. Misalignment of the floor of the balcony and the internal floor can reduce the perception of quality of the completed building and can also result in an unacceptable step which would restrict wheelchair access to the balcony. Furthermore, with such a clamping mechanism, height adjustment is typically achieved by the insertion of shims. This requires the slackening of the clamping jaws of one of the clamps, which reduces the overall clamping of the balcony to the attachment beams and therefore reduces safety during the time of height adjustment.

As described above, cassette balconies are assembled off-site. Decking for the balconies may be separable from the beams, joists and rafters which form the structure of the cassette balcony. An advantage of this is that components of the cassette balcony below the floor can be accessed as described above. In addition, decking can be changed by either the manufacturer, the building constructor or the end-user of the balcony. However, changing the decking of the balcony when the balcony is in place can be dangerous, as large gaps or holes will be created in the floor during this process. Furthermore, fixing the decking to the beams, joists or rafters when manufacturing the cassette balcony can be a time consuming process and increase the manufacturing costs. Many conventional balconies have decking formed from panels or boards which have gaps between them. When installing a balcony at height, there is a risk that tools or debris from the installation will fall through these gaps.

When the balcony cassette is installed on the building, it is of course important that the balcony remains safely attached to the building. In certain extreme circumstances, it is possible that one of the clamping mechanisms could fail. This could be due to the building being subjected to unexpected conditions (e.g. an earthquake). Alternatively, the building may be subjected to vibration over time, for example due to proximity to infrastructure such as railways or roads with heavy traffic. In these circumstances, there is a risk of the balcony sliding on the attachment beam. This would be dangerous for the user of the balcony. In a worst case scenario, the balcony may slide partially or completely off the attachment beam.

The present invention has been devised in light of the above considerations. The present invention seeks to avoid, ameliorate or overcome at least one of the above considerations.

SUMMARY OF THE INVENTION

In a first development of the present invention, rafters of the balcony also provide a safe, usable floor surface for the end-user of the balcony to stand on, without the need for separate decking and additionally or alternatively provides a suitable base for the balcony without the need for a separate soffit.

In a first aspect of the first development there is provided a balcony attachable to an attachment beam extending from a building in order to attach the balcony with respect to the building, the balcony comprising: a floor which provides a safe, usable surface for the end-user of the balcony to stand on; and a plurality of rafters each comprising: a floor portion which defines a part of the floor, and a strengthening portion which is located below the floor portion and extends downwardly from the floor portion, wherein the floor portions of the rafters cooperate to define the floor, and wherein each of the plurality of rafters is an integrally formed component.

By providing a balcony cassette according to the first aspect of the first development, a safe and usable balcony floor can be provided which may not require additional components such as decking in order to be used safely by the end user of the balcony or someone installing the balcony. As the floor is defined by the floor portion of the rafters, the number of components and construction cost of the balcony may be reduced. Further, the balcony may be more easily constructed because the floor portion and the strengthening portion of each rafter are integrally formed.

The floor may be substantially continuous e.g. the floor may not comprise any large gaps or holes. Specifically, the floor may comprise apertures which are no greater than 30 mm in a first dimension within a plane of the floor. These are referred to here as small apertures. Said small aperture may be configured to allow drainage (e.g. said small apertures may be drainage weep apertures). Said small apertures may be configured to permit access to components below the floor (see developments/aspects below).

It is expected that in some implementations, there may be a need to provide relatively large access apertures in the floor and/or base. Such access apertures may be required for example to connect services such as lighting. However, where present, it is intended that such access apertures would be covered in normal use of the balcony with respective access hatches.

The plurality of rafters each have a length. The plurality of rafters may each extend in a balcony projection direction (i.e. in a direction that the balcony projects from the building when attached). Accordingly, the length of each rafter may be parallel to the projection direction. Thus, the balcony may comprise a plurality of parallel rafters. Each of the plurality of rafters may be in abutment with one or more adjacent rafters. For example, each of the plurality of rafters may be in abutment with one or more adjacent rafters in a balcony width direction (i.e. a direction parallel to the width of the balcony and perpendicular to both a balcony thickness direction (measured in the vertical direction after installation of the balcony) and the balcony projection direction). Specifically, each rafter may be in abutment with a first adjacent rafter on a first side of the each rafter in the width direction and a second adjacent rafter on a second side of the each rafter in the width direction. As described in more detail below, a floor closer rafter and a base closer rafter are typically provided at opposing sides of the balcony in the width direction.

Each of the plurality of rafters may be in abutment with one or more adjacent rafters at the floor portion of each rafter. In other words, each floor portion of the plurality of rafters may be in abutment with one or more adjacent floor portions. Each floor portion of the plurality of rafters may be in abutment with adjacent floor portions i.e. all floor portions adjacent to the each floor portion. For example, each of the floor portions may be in abutment with one or more adjacent floor portions in the balcony width direction. Specifically, each floor portion may be in abutment with a first adjacent floor portion on a first side of the floor portion in the width direction and a second adjacent floor portion on a second side of the floor portion in the width direction (opposite the first side).

By providing a plurality of rafters wherein each floor portion is in abutment with adjacent floor portions the floor of the balcony may be more safe and usable by an end-user without the addition of other components such as decking. It may also reduce the chances of tools, debris or other items falling from the balcony during installation or use. Further, once installed, the balcony may be ready for immediate use by an end-user or construction worker.

The strengthening portions of each rafter may be spaced from each other in the balcony width direction. Voids (i.e. cavities) may be formed between the strengthening portions. For example, a void may be formed between a first strengthening portion and a second strengthening portion adjacent to the first strengthening portion. The voids may be further defined by a part of the floor of the balcony e.g. the floor portion of one of the rafters. An attachment beam receiving aperture may open into one of the voids (e.g. the void between the first and second strengthening portions) so that an attachment beam may be received in said void via the attachment beam receiving aperture. The balcony may comprise more than one attachment beam receiving aperture, each attachment beam receiving aperture may open into a respective void between two adjacent strengthening portions.

The balcony may comprise a base below the floor. The base may be spaced from the floor by the strengthening portions of the plurality of rafters i.e. the base may be spaced from the floor in the balcony thickness direction. The base and the floor may be substantially parallel. Alternatively the base may have a fall angle relative to the floor, the fall angle being suitable to allow water drainage.

By providing a base, in embodiments where there are small apertures in the floor to permit access below the floor (see aspects/developments below), the risk of items such as tools or installation debris falling off the balcony may be reduced. Furthermore, the base forms a soffit for the balcony, presenting a neat appearance from below.

Each of the plurality of rafters may comprise a base portion. The base portion of each rafter may be connected to the respective strengthening portion i.e. the strengthening portion of each rafter may extend upwardly from the base portion. The base portion may define a part of the base. The strengthening portion may connect the floor portion and the base portion. The base portion may be integrally formed with the strengthening portion and the floor portion. The base portions of the plurality of rafters may cooperate to define the base.

By providing each rafter with a base portion, which cooperates with the other base portions to define the base, the base of the balcony may be defined entirely by the same rafters which define the floor. This means that the number of components and the construction time and cost of the balcony may be reduced compared to a balcony having base defined by a separate component e.g. a sheet of material.

Each base portion of the plurality of rafters may be in abutment with one or more adjacent base portions. Each base portion of the plurality of rafters may be in abutment with adjacent base portions i.e. all base portions adjacent to each base portion. For example, each of the base portions may be in abutment with one or more adjacent base portions in the balcony width direction. Specifically, each base portion may be in abutment with a first adjacent base portion on a first side of the base portion in the width direction and a second adjacent base portion on a second side of the base portion in the width direction (opposite the first side).

By providing a plurality of rafters wherein each base portion is in abutment with adjacent base portions, the base of the balcony may be a continuous (i.e. solid) base without the addition of other components. This may further reduce the chances of tools, debris, liquid or other items falling from the balcony during installation or use.

In embodiments comprising a base below the floor, voids formed between strengthening portions may be further defined by a part of the base e.g. the base portion of one of the rafters.

The floor portion has a length, a width and a thickness. Each of the length, width and thickness of the floor portion are measured in directions perpendicular each other. The width and thickness of the floor portion may be smaller than the length of the floor portion. The thickness of the floor portion may be smaller than the width of the floor portion. The thickness of the floor portion may be uniform. The length of the floor portion may be substantially the same as the length of the rafter. A surface of the floor portion having width and length (i.e. with the largest surface area) may define part of an upper surface of the floor.

By using a surface of the floor portion having the largest surface area to define part of an upper surface of the floor, the number of floor portions required to produce a floor of a given size may be reduced. Further, when in combination with the strengthening portion, having the floor portion in this orientation may improve the strength of the rafter.

Similarly, the strengthening portion has a length, a depth and a thickness. Each of the length, depth and thickness of the strengthening portion are measured in directions perpendicular to each other. The depth and thickness of the strengthening portion may be smaller than the length of the strengthening portion. The thickness of the strengthening portion may be smaller than the depth of the strengthening portion. In other words, the strengthening portion may have a similar shape to the floor portion. The thickness of the strengthening portion may be uniform. The length of the strengthening portion may be the same as the length of the rafter. The strengthening portion may be at a different orientation to the floor portion, with the effect that its thickness is measured in a different direction. The strengthening portion is rotated relative to the floor portion by an angle about an axis parallel to the length of the strengthening portion. For example, the angle may be about 90 degrees. In other words, the strengthening portion may be a web extending from the floor portion i.e. the depth of the strengthening portion may be substantially perpendicular to the width of the floor portion. The depth of the strengthening portion may vary along the length of the strengthening portion i.e. the depth may be greater at the front of the balcony (distant from the building when the balcony is attached to the building) than at the back of the balcony. In embodiments where the balcony has a base, the variation in depth of the strengthening portion may ensure water is drained from the balcony. This will be understood as the fall angle of the base, providing drainage from the floor of the balcony.

As will be well understood, the orientation of the strengthening portion with respect to the floor portion has the effect of stiffening the combination of the floor portion and strengthening portion (and so stiffening the rafter as a whole).

In embodiments having a base portion, the base portion has a length, a width and a thickness. Each of the length, width and thickness of the base portion are measured in directions perpendicular to each other. The width and thickness of the base portion may be smaller than the length of the base portion. The thickness of the base portion may be smaller than the width of the base portion. In other words, the base portion may have a similar shape to the floor portion. The base portion may have substantially the same shape as the floor portion. The thickness of the base portion may be uniform. The length of the base portion may be substantially the same as the length of the rafter. A face of the base portion having width and length may form part of a lower surface of the base. The base portion may be in substantially the same orientation as the floor portion. Use of the term "substantially" here is intended to take account of a possible fall angle of the base portion with respect to the floor portion, to provide drainage.

By providing the base portion and the floor potion in substantially the same orientation and the strengthening portion in a different orientation, the strength of the rafter and its resistance to stresses e.g. bending stresses is improved.

The floor portion and the base portion of each of the plurality of rafters may be laterally offset from each other (i.e. offset in a direction perpendicular to the balcony thickness direction). For example, both the floor portion and the base portion may extend away from the strengthening portion in opposite directions. Specifically, the floor portion and the base portion of each of the plurality of rafters may be laterally offset from each other in a direction parallel to the width of the floor portion. The direction parallel to the width of the floor portion may be the balcony width direction. For example, the floor portion of one of the plurality of rafters may be aligned with the base portion of an adjacent rafter (e.g. the first adjacent rafter). The base portion of said one of the plurality of rafters may be aligned with the floor portion of an adjacent rafter on the opposite side (e.g. the second adjacent rafter). Thus, when the balcony is installed, the floor portion of one of the plurality of rafters may be directly above (i.e. vertically aligned with) the base portion of an adjacent rafter (e.g. the first adjacent rafter)and the base portion of said one of the plurality of rafters may be directly below (i.e. vertically aligned with) the floor portion of an adjacent rafter on the opposite side (e.g. the second adjacent rafter). In other words, each of the rafters may have a Z-shaped, step-shaped or S-shaped transverse (i.e. perpendicular to the length of the rafter) cross-section.

By providing rafters with a Z-shaped, step-shaped or S-shaped transverse cross-section, the structure of the cassette balcony may be improved. In particular, by providing rafters having floor portions and base portions which are laterally offset from each other, the balcony as a whole may be less susceptible to failure if one of the rafters were to fail. This is due to the additional safety which may be provided when one rafter (e.g. a floor portion of the rafter) partially overlays another rafter (e.g. a base portion of the other rafter). Thus for failure to occur which results in damage to or a gap in both the floor and the base at a particular location, more than one rafter must fail.

Alternatively, the floor portion and the base portion may extend away from the strengthening portion in the same direction. In this example, the rafters may have a C-shaped cross section.

The rafters (excluding a floor closer rafter and a base closer rafter, described below) may have a structure which is substantially identical (as described above). By providing a balcony where rafters are substantially identical, manufacturing costs may be reduced.

The floor may comprise a floor closer rafter. The floor closer rafter has a length. The length of the floor closer rafter may be the same as the length of each of the plurality of rafters. The floor closer rafter may align with the plurality of rafters (e.g. in the balcony width direction). The floor closer rafter may be parallel to the plurality of rafters. The floor closer rafter may account for the difference between the extensions of the floor and the base in the balcony width direction at a first side of the balcony. In embodiments where the floor portion and base portion of each of the plurality of rafters are laterally offset from each other, the base may extend further than the floor in the balcony width direction (e.g. from a centre of the balcony) at a first side of the balcony. Accordingly, the floor closer rafter may have a width which is approximately the same as the difference between the respective extensions of the floor and the base in the balcony width direction on the first side of the balcony. For example, the floor closer rafter may have a width which is the same as the width of a base portion at the first side of the balcony.

The base may comprise a base closer rafter. The base closer rafter has a length. The length of the base closer rafter may be the same as the length of each of the plurality of rafters. The base closer rafter may align with the plurality of rafters (e.g. in the balcony width direction). The base closer rafter may be parallel to the plurality of rafters. The base closer rafter may account for the difference between the extensions of the floor and the base in a balcony width direction at a second side of the balcony, opposite the first side of the balcony. In embodiments where the floor portion and base portion of each of the plurality of rafters are laterally offset from each other, the floor may extend further than the base in the balcony width direction (e.g. from the centre of the balcony) at a second side of the balcony. Accordingly, the base closer rafter may have a width which is approximately the same as the difference between the respective extensions of the floor and the base in the balcony width direction on the second side of the balcony. For example, the base closer rafter may have a width which is the same as the width of a floor portion at the second side of the balcony.

By providing a floor closer rafter and a base closer rafter, the floor and the base of the balcony may primarily be made from rafters such as those with Z-shaped, step-shaped or S-shaped transverse cross-sections whilst at the same time allowing the floor and the base to be the same width and to align in the balcony thickness direction (and thus be vertically aligned when the balcony is installed). Therefore, the floor closer rafter and the base closer rafter allow the use of rafters which may improve the strength of the balcony as described above.

The balcony according to the first aspect of the first development may also comprise features of conventional balconies or conventional cassette balconies. These may include one or more of: one or more balusters; a handrail supported by the balusters (the combination forming a balustrade); one or more soffits; a frame which may surround the floor and/or base at the front, back and sides of the balcony (which may be between the floor and the base); and drainage ducts (some of which may be sloped).

The floor portion of each rafter may comprise a floor portion lip to allow connection with an adjacent rafter (e.g. the first adjacent rafter). Connection with an adjacent rafter may be achieved with fixings (e.g. rivets). The floor portion of the rafter may comprise a series of floor portion castellation lips on the same side of the respective rafter to allow connection with an adjacent rafter (e.g. the first adjacent rafter).

The base portion of each rafter may comprise a base portion lip (e.g. a continuous base portion lip) to allow connection with an adjacent rafter (e.g. the second adjacent rafter). Connection with an adjacent rafter may be achieved with fixings (e.g. rivets).

Each of the plurality of rafters (which are integrally formed components) may be a folded sheet of material e.g. a folded metal sheet such as aluminium sheet. Each folded sheet of material which defines a rafter may have a respective fold line (e.g. a first fold line) between the floor portion and the strengthening portion which may extend the length of the respective rafter. In embodiments where the base portion and the strengthening portion are integrally formed, each folded sheet of material may have a second fold line between the base portion and the strengthening portion which may extend the length of the respective rafter. In embodiments wherein the floor comprises small apertures, the apertures may be located adjacent to respective fold lines (e.g. first fold lines) of the plurality of rafters.

In a second aspect of the first development there is provided a balcony attachable to an attachment beam extending from a building in order to attach the balcony with respect to the building, the balcony comprising: a floor for the end-user of the balcony to stand on, a base below the floor; and a plurality of rafters between the floor and the base, wherein the rafters each comprise: a strengthening portion which is located below the floor and extends downwardly from the floor, and a base portion, the base portion of each rafter being formed integrally with the strengthening portion of the respective rafter, and wherein the base portions of the plurality of rafters cooperate to define the base.

The base of the balcony may interchangeably be referred to herein as the soffit.

By providing each rafter with a base portion, which cooperates with the other base portions to define the base, the base of the balcony may be defined entirely by the rafters. This means that the number of components and the construction time and cost of the balcony may be reduced compared to a balcony having base defined by a separate component e.g. a sheet of material.

In this aspect, it is not necessary for the floor to be formed from floor portions that are integrally formed with the rafters. The floor may instead be provided by decking panels.

Optional features set out with respect to the first aspect may also apply to the second aspect.

In a third aspect of the first development there is provided a building comprising a balcony according to the first aspect of the first development, or according to the second aspect of the first development, and comprising one or more attachment beams which support the balcony. The one or more attachment beams may support the balcony by passing through respective attachment beam receiving apertures and into respective voids between two adjacent strengthening portions.

A second development of the present invention relates to a clamping mechanism for attaching a balcony to an attachment beam extending from a building.

In a first aspect of the second development there is provided a balcony attachable to an attachment beam extending from a building in order to attach the balcony with respect to the building, the attachment beam having a lateral recess comprising: a first surface; and a second surface facing the first surface, the balcony comprising: a floor suitable for a balcony occupant to stand on; and a clamping mechanism located below the floor and engageable with the attachment beam, the clamping mechanism comprising: a first adjustable clamping arm for engaging with the attachment beam; and a second adjustable clamping arm spaced from the first clamping arm in a clamping arm spacing direction for engaging with the attachment beam, wherein the first and second clamping arms are configured to engage with the attachment beam by applying pressure respectively to the first surface and to the second surface of the lateral recess.

By providing a balcony having a clamping mechanism which provides pressure respectively to the first and second surfaces of a lateral recess as described above, the balcony may be secured to the building without the need for clamping bars which engage with external outer surfaces of the attachment beam such as an upper and lower surface of the attachment beam. As such, the floor of the balcony may be brought closer to an upper surface of the attachment beam which may allow the balcony floor to better complement the building design and the location of the attachment beams relative to the internal floor of the building. It may also reduce the thickness of the balcony which may improve the appearance of the completed building and the cost of the balcony.

The positions of the first and second clamping arms may be independently adjustable. In other words, the location of the first clamping arm relative to the balcony may be changeable without changing the location of the second clamping arm relative to the balcony. Similarly, the location of the second clamping arm relative to the balcony may be changeable without changing the location of the first clamping arm relative to the balcony.

By providing first and second clamping arms having positions that are independently adjustable, the level of the balcony (e.g. relative to the level of the building or the ground) may be accurately controlled. This may be particularly useful when using multiple clamping mechanisms with the same balcony which engage with one or more attachment beams (see below). Furthermore, the provision of such a clamping mechanism means that adjustment of the height of the floor of the balcony may be achieved without the need to loosen the clamping mechanism to insert one or more shims.

The first clamping arm may be aligned with the second clamping arm. The first clamping arm may be aligned with the second clamping arm in the clamping arm spacing direction. The clamping arm spacing direction may be parallel to the balcony thickness direction (e.g. the first clamping arm and the second clamping arm may be vertically aligned when the balcony is installed on the building).

By providing first and second clamping arms which are aligned, moments caused by the clamping arms applying pressure at different lateral locations along the attachment beam may be reduced. This may reduce the magnitude of some stresses in the beam.

The clamping mechanism may comprise a housing. The first clamping arm may extend from the housing. The second clamping arm may extend from the housing.

The movement of the first clamping arm may be limited by a first housing end stop. The first housing end stop may be at one end of the housing. The first housing end stop may be at one end of the housing in the clamping arm spacing direction (i.e. in the balcony thickness direction or, when the balcony is installed, in the vertical direction). The first housing end stop may extend in the same direction as the direction the first clamping arm extends from the housing. The first housing end stop may be configured to abut the first clamping arm such that the first clamping arm cannot move past the first housing end stop (in a direction away from the second clamping arm).

The movement of the second clamping arm may be limited by a second housing end stop. The second housing end stop may be at an end of the housing opposite the first housing end stop. The second housing end stop may extend in the same direction as the direction the second clamping arm extends from the housing. The second housing end stop may be configured to abut the second clamping arm such that the second clamping arm cannot move past the second housing end stop (in a direction away from the first clamping arm).

By providing first and second end stops to limit the movement of the first and second clamping arms respectively, the clamping mechanism may be prevented from unintentionally separating into the various components when operated.

The balcony may be according to the first aspect of the first development. For example, the balcony may comprise a floor suitable for a balcony occupant to stand on; and a plurality of strengthening portions of respective rafters, each located below the floor. The clamping mechanism may be located below the floor. The clamping mechanism may be located between the floor and the base. The clamping mechanism may be fixed to a strengthening portion (e.g. the first strengthening portion). The first and second clamping arms may extend away from the first strengthening portion. Specifically, the housing of the clamping mechanism may be fixed to the strengthening portion (e.g. the first strengthening portion). The first and second clamping arms may extend into one of the voids into which an attachment beam may be received (e.g. the void formed between the first and second strengthening portions).

By providing a clamping mechanism fixed to a strengthening portion, the clamping mechanism may have a reduced effect on the appearance of the balcony and may also be located close to the void into which the attachment beam may pass when the balcony is attached to the building.

In embodiments where the clamping mechanism is fixed to a strengthening portion (e.g. the first strengthening portion), the strengthening portion may comprise an aperture. The housing of the clamping mechanism may be fixed (e.g. using fasteners) over the aperture. A part of the clamping mechanism may extend through the aperture. Specifically, the first and second clamping arms may extend through the aperture. For example, the first and second clamping arms may extend through the aperture and into the void between the first and second strengthening portions. In other words, the housing may be fixed to the strengthening portion (e.g. the first strengthening portion) on a side of the strengthening portion outside one of the voids into which an attachment beam may be received (e.g. the void between the first and second strengthening portions).

By providing the housing outside of one of the voids into which an attachment beam may be received, more space may be provided inside the void to contain the attachment beam when the balcony is attached to the building. This may improve the design options of the balcony, for example, by reducing the minimum size of the void.

The clamping mechanism may comprise a stiffener located between the first and second clamping arms. The stiffener may be fixed relative to the housing e.g. the stiffener may be fixed relative to the housing in the balcony thickness direction. The stiffener may limit the movement of the first clamping arm e.g. in a direction opposite a direction limited by the first housing end stop. The stiffener may be configured to abut the first clamping arm such that the first clamping arm cannot move past the stiffener (in a direction towards the second clamping arm). For example, a first surface of the stiffener may be configured to abut the first clamping arm. In other words, at the extremities of the first clamping arm movement, the first clamping arm may abut either the first housing end stop or the stiffener.

The stiffener may limit the movement of the second clamping arm e.g. in a direction opposite a direction limited by the second housing end stop. The stiffener may be configured to abut the second clamping arm such that the second clamping arm cannot move past the stiffener (in a direction towards the first clamping arm). For example, a second surface of the stiffener, opposite the first surface of the stiffener may be configured to abut the second clamping arm. In other words, at the extremities of the second clamping arm movement, the second clamping arm may abut either the second housing end stop or the stiffener.

By providing a stiffener located between the first and second clamping arms, the first and second clamping arms are prevented from making contact. This may reduce damage to the clamping arms. Further, it may prevent either clamping arm from moving too far from an approximate location for engaging with the attachment beam, before the balcony is attached to the building. This may reduce the balcony installation time.

The clamping mechanism may comprise one or more adjusters. The first and second clamping arms may be adjustable by said one or more adjusters. The first and second clamping arms may be adjustable in a linear direction. The first clamping arm and the second clamping arm may be adjustable by respective adjusters. For example, the first clamping arm may be adjustable by a first adjuster. The second clamping arm may be adjustable by a second adjuster.

Each of the adjusters may be as described in the first aspect of the third development. For example, each adjuster may be a threaded shaft (e.g. a lead screw). The first clamping arm may comprise a first threaded hole cooperable (i.e. engageable) with the threaded shaft of the first adjuster. The second clamping are may comprise a second threaded hole cooperable (i.e. engageable) with the threaded shaft of the second adjuster. Further, a rotation of each adjuster may result in linear motion of the corresponding clamping arm.

The first adjuster may extend from the first housing end stop towards the second housing end stop i.e. the first adjuster extends parallel to the clamping arm spacing direction (in a vertical direction when the balcony is installed). The second adjuster may extend from the top of the first clamping arm to the second housing end stop i.e. the second adjuster extends parallel to the clamping arm spacing direction (in a vertical direction when the balcony is installed). Both the first and second adjusters may pass through the first and second clamping arms. The first adjuster may engage with the first clamping arm (e.g. as described above). The second adjuster may engage with the second clamping arm (e.g. as described above). The first clamping arm may comprises a first clearance hole (e.g. a clearance hole which is not threaded). The second adjuster may pass through the first clearance hole. The second clamping arm may comprise a second clearance hole (e.g. a clearance hole which is not threaded). The first adjuster may pass through the second clearance hole. The first and second adjusters may constrain the movement of the first clamping arm i.e. constrain the number of degrees of freedom of the first clamping arm. The first and second adjusters may constrain the movement of the second clamping arm i.e. constrain the number of degrees of freedom of the second arm. The first and second adjusters may constrain the movement of the first clamping arm such that rotational movement of the first clamping arm (e.g. about an axis parallel to the clamping arm spacing direction) is prevented. In other words, the first and second adjusters may constrain the first clamping arm to movement parallel to the clamping arm spacing direction (i.e. vertical movement when the balcony is installed). The first and second adjusters may be laterally spaced so that the movement of the first clamping arm is constrained to vertical movement. The first and second adjusters may constrain the movement of the second clamping arm such that rotational movement of the second clamping arm (e.g. about an axis parallel to the clamping arm spacing direction) is prevented. In other words, the first and second adjusters may constrain the second clamping arm to movement parallel to the clamping arm spacing direction (i.e. vertical movement when the balcony is installed). The first and second adjusters may be laterally spaced so that the movement of the second clamping arm is constrained to vertical movement.

By constraining the movement of the first and second clamping arms, the first and second clamping arms may be more quickly and accurately adjusted in the desired direction so that they are in a good position to engage with the attachment beam and secure the balcony to the building more safely.

The first housing end stop may be provided with one or more access holes. The access holes may allow the adjusters to be accessible and operable to adjust the respective clamping arms from one side of the clamping mechanism. For example, the second adjuster may be accessible and operable via one of the access holes to adjust the second clamping arm.

By providing clearance holes and access holes as described above, all of the adjusters of the clamping mechanism may be accessible and operable to adjust the respective clamping arms from one side of the clamping mechanism. More specifically, all the adjusters of the clamping mechanism may be accessible and operable to adjust the respective clamping arms from the floor of the balcony (see below). This may reduce the time taken to engage the clamping mechanism with the attachment beam and install the balcony.

In embodiments comprising a stiffener located between the first and second clamping arms, the stiffener may comprise one or more stiffener clearance holes. The respective adjusters may pass through the one or more stiffener clearance holes.

By providing a stiffener having respective stiffener clearance holes through which each adjuster may pass, the stiffener may help to maintain the location and orientation of the adjusters. This may ensure that the first and second clamping arms are in a good position to engage with the attachment beam and secure the balcony to the building more safely. Furthermore, the stiffener may help to maintain the shape of the adjusters, which may otherwise bend when the clamping mechanism is under clamping load.

Each clamping arm may be hollow. Each clamping arm may have a C-shaped transverse cross-sectional shape i.e. transverse to the direction of extension of each clamping arm. By providing clamping arms that are hollow, the weight of the clamp and thus the balcony may be reduced.

The balcony may comprise a plurality of clamping mechanisms e.g. the balcony may comprise two, three, four, five, six, seven, eight, or more clamping mechanisms. The clamping mechanisms may each be as described above. The plurality of clamping mechanisms may be engageable with the same attachment beam or a different attachment beam. Two or more clamping mechanisms may align in the balcony projection direction. Each of these clamping mechanisms aligned in the balcony projection direction may be engageable with the same attachment beam. Alternatively or in addition, two or more clamping mechanisms may align in the balcony width direction. Each of these clamping mechanism aligned in the balcony width direction may be engageable with the same attachment beam. Each of these clamping mechanisms aligned in the balcony width direction may be engageable with different attachment beams. In alternative embodiments, for example for a balcony of irregular shape, the clamping mechanisms may not be aligned with each other.

By providing a balcony with a plurality of clamping mechanisms, the balcony may be attached more securely to the building via one or more attachment beams. Further, by having more than one clamping mechanism for each attachment beam, the balcony may remain attached to the building even if one of the clamps were to fail.

The attachment beam may be an I-beam.

In a second aspect of the second development there is provided a building comprising a balcony according to the first aspect of the second development, the building comprising an attachment beam and wherein the clamping mechanism of the balcony is engaged with the attachment beam such that the balcony is attached with respect to the building.

In a third aspect of the second development there is provided a balcony according to the first aspect of the second development comprising a clamping set comprising: the clamping mechanism engageable with the attachment beam; and a counterpart clamping mechanism engageable with the attachment beam or a second attachment beam, the counterpart clamping mechanism comprising: a first counterpart adjustable clamping arm for engaging with the attachment beam or the second attachment beam; and a second counterpart clamping arm spaced from the first counterpart clamping arm for engaging with the attachment beam or the second attachment beam, the attachment beam or the second attachment beam having a counterpart lateral recess comprising: a first counterpart surface; and a second counterpart surface facing the first counterpart surface, wherein the first and second counterpart clamping arms are configured to engage with the attachment beam or the different attachment beam by applying pressure respectively to the first counterpart surface and the second counterpart surface of the counterpart lateral recess, and wherein the counterpart clamping mechanism is spaced from the clamping mechanism in a balcony width direction.

By providing a balcony comprising a clamping set as described above, the balcony may be attached more securely to the attachment beam. Furthermore, the level of the balcony relative to the building may be more accurately controlled by respectively adjusting the clamping arms of the clamping mechanism and the counterpart clamping arms of the counterpart clamping mechanism. Additionally, in embodiments wherein the clamping mechanism and the counterpart clamping mechanism engage with two different attachment beams more support and stability may be provided for the balcony.

The counterpart clamping mechanism may comprise any of the features of the clamping mechanism described in the first aspect of the second development, either singly or in combination.

The clamping mechanism and the counterpart clamping mechanism may be aligned e.g. in the balcony width direction.

By providing a clamping mechanism and counterpart clamping mechanism that are aligned in the balcony width direction, moments experienced by the balcony about certain directions may be reduced, which may reduce some stresses in the balcony.

The first and second counterpart clamping arms may extend towards the clamping mechanism. The first and second clamping arms may extend towards the counterpart clamping mechanism. In other words, the first and second clamping arms and the first and second counterpart clamping arms may extend towards each other e.g. parallel to the balcony width direction. In embodiments where the clamping mechanism is fixed to the first strengthening portion, the counterpart clamping mechanism may be fixed to the second strengthening portion. The first and second clamping arms and the first and second counterpart clamping arms may extend towards each other into the void between the first and second strengthening portions. In other embodiments, the first and second clamping arms and the first and second counterpart clamping arms may extend towards each other into one of the other voids which may receive an attachment beam.

By providing first and second clamping arms and the first and second counterpart clamping arms which extend towards each other into the void between the first and second strengthening portions, the clamping mechanism and the counterpart clamping mechanism may be attached to opposite sides of the same attachment beam. This may improve safety of securing the balcony to the attachment beam.

The balcony may comprise a plurality of clamping sets as described above e.g. the balcony may comprise two, three, four, five, six, or more clamping sets. Two or more clamping sets may be aligned in the balcony projection direction. These clamping sets aligned in the balcony projection direction may engage with the same attachment beam. Two or more clamping sets may be aligned in the balcony width direction. These clamping sets aligned in the balcony width direction may engage with different attachment beams. The plurality of clamping sets may form a grid of clamping sets aligned in the balcony width direction and the balcony projection direction.

By providing a balcony with a plurality of clamping sets, the balcony may be attached more securely to the building via more than one attachment beam. Further, by having more than one clamping set for each attachment beam, the balcony may remain attached to the building even if one of the clamping sets were to fail.

In a fourth aspect of the second development there is provided a building comprising a balcony according to the third aspect of the second development and one or more attachment beams extending from the building, wherein one or more clamping sets are engaged with the attachment beam(s) such that the balcony is attached with respect to the building. Each attachment beam may comprise a lateral recess on a first side. The lateral recess may be configured to receive the first and second clamping arms. Each attachment beam may have the counterpart lateral recess on a second side opposite the first side. The counterpart lateral recess may be configured to receive the first and second counterpart clamping arms.

As described above, the first and second clamping arms are configured to engage with the attachment beam by applying pressure respectively to the first surface and to the second surface of the lateral recess. In other words, the first and second clamping arms may engage with the attachment beam via an interference fit with the opposite first and second surfaces of the lateral recess. As described above, the first and second counterpart clamping arms are configured to engage with the attachment beam by applying pressure respectively to the first counterpart surface and to the second counterpart surface of the counterpart lateral recess. In other words, the first and second counterpart clamping arms may engage with the attachment beam via an interference fit with the opposite first and second counterpart surfaces of the counterpart lateral recess.

By providing the lateral recess and the counterpart lateral recess, the clamping mechanism and counterpart clamping mechanism described above can be used to attach the balcony with the building. This may save space in one of the voids which receive an attachment beam (e.g. the void between the first and second strengthening portions which receives the attachment beam).

In an fifth aspect of the second development there is provided a method for attaching a balcony to an attachment beam extending from a building in order to attach the balcony with respect to the building, the attachment beam having a lateral recess comprising: a first surface; and a second surface facing the first surface, the balcony comprising: a clamping mechanism engageable with the attachment beam, the clamping mechanism comprising: a first adjustable clamping arm for engaging with the attachment beam; and a second adjustable clamping arm spaced from the first clamping arm in a clamping arm spacing direction for engaging with the attachment beam, the method comprising the steps of: locating the balcony on the attachment beam; moving the first and second clamping arms apart so that the first and second clamping arms engage with the attachment beam by applying pressure respectively to the first surface and to the second surface of the lateral recess.

The balcony may be a balcony according to the first aspect of the second development.

The clamping mechanism may be engaged with the attachment beam through the following steps. The second clamping arm is rested on an upward facing surface of the lateral recess e.g. on the second surface. The first clamping arm is then adjusted to abut a downward facing surface of the lateral recess e.g. the first surface. Consequently, the first and second clamping arms may apply pressure respectively to the first surface and to the second surface of the lateral recess.

The balcony may comprise a clamping set comprising: the clamping mechanism engageable with the attachment beam; and a counterpart clamping mechanism engageable with the attachment beam or a second attachment beam, the counterpart clamping mechanism comprising: a first counterpart adjustable clamping arm for engaging with the attachment beam or the second attachment beam; and a second counterpart clamping arm spaced from the first counterpart clamping arm for engaging with the attachment beam or the second attachment beam, the attachment beam or the second attachment beam having a counterpart lateral recess comprising: a first counterpart surface; and a second counterpart surface facing the first counterpart surface, wherein the counterpart clamping mechanism is spaced from the clamping mechanism in a balcony width direction. The method may comprise the further step of: moving the first and second counterpart clamping arms apart so that the first and second counterpart clamping arms engage with the attachment beam by applying pressure respectively to the first counterpart surface and to the second counterpart surface of the counterpart lateral recess.

The balcony may be as described in the third aspect of the second development.

The counterpart clamping mechanism may be engaged with the attachment beam through the following steps. The second counterpart clamping arm is rested on an upward facing surface of the counterpart lateral recess e.g. on the counterpart second surface. The first counterpart clamping arm is then adjusted to abut a downward facing surface of the counterpart lateral recess e.g. the counterpart first surface. Consequently, the first and second counterpart clamping arms may apply pressure respectively to the first counterpart surface and to the second counterpart surface of the counterpart lateral recess.

The method may further comprise the step of: moving any of the first and second clamping arms and the first and second counterpart clamping arms so that the balcony is level with the building and/or so that the balcony is a desired height from the ground. Such steps may be taken before either clamping mechanism is fully tightened.

The balcony may be levelled by independently adjusting any of the first and second clamping arms and the first and second counterpart clamping arms.

A third development of the present invention relates to a manner for adjustment of a clamping mechanism for attaching a balcony to a building.

In a first aspect of the third development, there is provided a balcony attachable to one or more attachment beams extending from a building in order to attach the balcony with respect to the building, the balcony comprising: a floor suitable for a balcony occupant to stand on; and a clamping mechanism located below the floor and engageable with an attachment beam in order to attach the balcony to the attachment beam, the clamping mechanism comprising: a clamping bar for engaging with the attachment beam; and an adjuster for adjusting the clamping bar such that the clamping bar engages with the attachment beam, wherein the floor comprises an aperture which extends through the floor in an aperture extension direction and the adjuster is aligned with the aperture such that the adjuster is accessible and operable via the aperture to adjust the clamping bar, and wherein the aperture has a first dimension perpendicular to the aperture extension direction which is between about 5 mm and about 30 mm, and wherein the aperture has a second dimension perpendicular to the first dimension and the aperture extension direction which, in the region of the aperture which has the first dimension, is between about 5 mm and about 500 mm.

By providing a balcony wherein the adjuster is aligned with the aperture, it is possible to adjust the position of the clamping bar without removing a part of the floor. In addition, by providing an aperture which has the first and second dimensions described above, the balcony may be safe for a user to stand on, whilst allowing the adjuster to be accessed and operated to adjust the clamping bar. The apertures may not need to be covered when the balcony is in use. The risk to an installation worker may be reduced compared to a balcony where a part of the floor is removed to access the adjuster which creates a large gap or hole. There may also be reduced risk of tools or other installation debris falling through large holes or gaps in the balcony as a result of a part of the floor being removed. Furthermore, as a part of the floor does not need to be removed in order to access and operate the adjuster to adjust the clamping bar, the installation time of the balcony may be reduced.

Where the aperture has a shape such that the first dimension varies depending on the region of the aperture measured, it is intended that the requirement for the second dimension is satisfied for the region of the aperture in which the requirement for the first dimension is satisfied. This is what is to be understood by "in the region of the aperture which has the first dimension". The first dimension is in a plane of the floor. The second dimension is also in a plane of the floor. The aperture described above may be the small aperture referred to in the first aspect of the first development.

As described above, the first dimension of the aperture may be between about 5 mm and about 30 mm. For example the first dimension of the aperture may be approximately any one of 5 mm, 6 mm, 7 mm, 8 mm, 9 mm, 10 mm, 11 mm, 12 mm, 13 mm, 14 mm, 15 mm, 16 mm, 17 mm, 18 mm, 19 mm, 20 mm, 21 mm, 22 mm, 23 mm, 24 mm, 25 mm, 26 mm, 27 mm, 28 mm, 29 mm, or 30 mm, or in any range provided by a combination of any of these values as respective end points of the range. Preferably the first dimension is about 9 mm. This is considered to be an acceptable space for insertion and rotation of a suitable adjustment tool. Additionally, such dimensions allow for adequate drainage of the floor space.

As described above, the second dimension of the aperture may be between about 5 mm and 500 mm. For example the second dimension of the aperture may be approximately any one of 5 mm, 10 mm, 20 mm, 30 mm, 40 mm, 50 mm, 60 mm, 70 mm, 80 mm, 90 mm, 100 mm, 108 mm, 150 mm, 200 mm, 250 mm, 300 mm, 350 mm, 400 mm, 450 mm, or 500 mm, or in any range provided by a combination of any of these values as respective end points of the range. Preferably the second dimension is about 108 mm.

The area of the aperture (perpendicular to the aperture extension direction) in the region of the aperture which has the first dimension is defined by the first dimension and the second dimension. The area of the aperture in the region of the aperture which has the first dimension may be between about 20 $mm^2$ and about 5000 $mm^2$. For example, the area of the aperture in the region of the aperture which has the first dimension may be approximately any one of 20 $mm^2$, 25 $mm^2$, 50 $mm^2$, 75 $mm^2$, 100 $mm^2$, 200 $mm^2$, 300 $mm^2$, 400 $mm^2$, 500 $mm^2$, 600 $mm^2$, 700 $mm^2$, 800 $mm^2$, 900 $mm^2$, 1000 $mm^2$, 1500 $mm^2$, 2000 $mm^2$, 2500 $mm^2$, 3000 $mm^2$, 3500 $mm^2$, 4000 $mm^2$, 4500 $mm^2$, or 5000 $mm^2$, or in any range provided by a combination of any of these values as respective end points of the range. Preferably the area of the aperture in the region of the aperture which has the first dimension is about 972 $mm^2$.

The aperture extends through the floor e.g. the aperture may extend through the floor in a direction parallel to the balcony thickness direction.

The adjuster may be vertically aligned with the aperture i.e. the adjuster may be aligned in the balcony thickness direction. In other words, when the balcony is installed, the aperture may be above (e.g. directly above) the adjuster. Alternatively, the adjuster may be set obliquely to the aperture so that an adjustment tool can pass through the aperture and reach the adjuster.

By providing an adjuster which vertically aligns with the aperture, the adjuster may be more easily accessible from above the floor. However, as will be understood, it may be advantageous to have an oblique setting of the adjuster with respect to the aperture.

The aperture may be a drainage weep aperture. Note that it is not necessary for each aperture to be located in register with a corresponding adjuster. Some apertures may solely be for providing drainage. Others may have the dual function of drainage and access to an adjuster. The apertures may be arranged in any suitable arrangement, such as in a regular or repeating arrangement, at least in part to provide an aesthetic effect.

By providing a balcony wherein the adjuster is aligned with a drainage weep aperture, the position of the clamping bar may be adjusted without the need for additional apertures in the floor in order to access the adjuster. This may improve the visual appearance and/or the structural integrity of the floor e.g. the number of stress raising features in the floor may be reduced.

The balcony may be as described in any of the preceding developments/aspects. Consequently, the floor may comprise a plurality of floor portions. The aperture may be defined by one or more of the floor portions. The aperture may be defined by two adjacent floor portions. For example, one or more edges of the aperture may be defined by a first floor portion. The remaining edge(s) of the aperture may be defined by a second floor portion, adjacent to the first floor portion.

By providing an aperture defined by two adjacent floor portions, the aperture may be located in the floor without affecting the appearance of the floor (e.g. the aperture may be more concealed at the abutment of two adjacent floor portions). Furthermore, when manufacturing the balcony, there may be no need for an additional processing step to create the aperture (e.g. drilling). For example, the aperture may be defined by the shape of two adjacent floor portions. This may reduce manufacturing time and cost.

Additionally or alternatively, one or more suitable apertures may be arranged to be enclosed by a floor portion. In this case, such apertures are not defined by the cooperation between adjacent floor portions. This may be suitable for a situation where an adjuster is not located to be aligned with a boundary between adjacent floor portions. In this example, the apertures may be located centrally in the floor portion.

The aperture may be an elongate aperture (e.g. the aperture may be a slot). The aperture may extend in the balcony projection direction. This may form the slot. An elongate edge of the slot may be defined by the first floor portion. The rest of the edge of the slot may be defined by the second floor portion adjacent to the first floor portion.

By providing an elongate aperture, an adjuster may be more easily accessed and operated. Furthermore, in embodiments with more than one adjuster (see below), the more than one adjusters may be more easily accessed and operated via the same aperture to adjust the respective clamping arm(s).

As another example of how the preceding aspects/developments may be combined with the first aspect of the third development, each of the floor portions may be in abutment with adjacent floor portions.

By providing a balcony wherein each of the floor portions is in abutment with adjacent floor portions, the balcony may have a safe, continuous floor (excluding the aperture) which may reduce the likelihood of tools or installation debris falling from the balcony.

The clamping mechanism may be a clamping mechanism according to the first aspect of the second development. Specifically, the clamping bar may be a clamping arm such as the first clamping arm or the second clamping arm described in the first aspect of the second development.

The balcony according to the first aspect of the third development may comprise more than one clamping bar e.g. more than one clamping arm e.g. the first clamping arm and the second clamping arm. Alternatively, the clamping mechanism may be a conventional clamping mechanism i.e. the clamping mechanism may engage the attachment beam between more than one clamping bar e.g. clamping jaws.

It is possible for the clamping mechanism to comprise a single adjuster. For example, this is possible where the adjuster has a first threaded portion and a second threaded portion with a thread in the opposite direction to the thread of the first threaded portion. The first and second threaded portions may cooperate respectively with the first and second clamping arms to drive them apart or drive them together, depending on the rotation of the adjuster.

The clamping mechanism may comprise a plurality of adjusters. For example, the clamping mechanism may comprise two, three, four, or more adjusters. The adjusters may be for adjusting respective one or more of the clamping bars. For example, there may be one adjuster for adjusting each respective clamping bar. In other words, the clamping mechanism may comprise: a plurality of clamping bars for engaging with the attachment beam; and a plurality of adjusters for adjusting respective clamping bars such that the respective clamping bars engage with the attachment beam, and wherein more than one of the plurality of adjusters may be aligned with the aperture such that more than one of the plurality of adjusters may be accessible and operable via the aperture to adjust the respective clamping bars. For example, the clamping mechanism may have two adjusters which are aligned with the aperture such as the first adjuster and the second adjuster described in the first aspect of the second development. Accordingly, the adjusters that are aligned with the aperture may be spaced laterally from each other i.e. spaced in a direction perpendicular to the balcony thickness direction. For example, the adjusters may be laterally spaced in the balcony projection direction. In embodiments where the aperture is an elongate aperture (slot), the adjusters may be laterally spaced in the direction of extension of the elongate aperture (e.g. in the balcony projection direction).

By providing access to more than one adjuster of a clamping mechanism via the same aperture, the clamping bars may be adjusted more quickly when attaching the balcony to the attachment beam. This may reduce installation time and cost.

The floor may comprise a plurality of apertures. Each aperture may be the same as the aperture described above. Respective groups of one or more of the plurality of adjusters may align with corresponding apertures. In other words, each group of adjusters may align with a different aperture in the floor of the balcony. For example, the clamping mechanism may comprise four adjusters, two adjusters may align with a first aperture and two adjusters may align with a second aperture. As an alternative example, the clamping mechanism may comprise four adjusters and each may align with a respective one of four apertures in the floor of the balcony.

By providing a floor that comprises more than one aperture, the adjusters may be more easily accessible without the need to alter the design of the clamping mechanism or provide excessively large apertures. In addition, if the balcony comprises multiple clamping mechanisms (as described in the third aspect of the second development), the plurality of apertures may allow all adjusters of all clamping mechanisms to be accessible and operable via the respective apertures to adjust the respective clamping bars. Further, when the apertures are drainage weep apertures, the drainage of liquid from the floor may be improved.

The balcony may comprise a plurality of clamping mechanisms. Each clamping mechanism may be as described in the preceding aspects. For example, each clamping mechanism may comprise a plurality of clamping bars (e.g. clamping arms) for engaging with the attachment beam; and a plurality of adjusters for adjusting respective clamping bars such that the respective clamping bars engage with the attachment beam, and wherein more than one of the plurality of adjusters is aligned with the aperture such that more than one of the plurality of adjusters is accessible and operable via the aperture to adjust the respective clamping bars The plurality of clamping mechanisms may be engageable with the same attachment beam. The plurality of clamping mechanisms may be engageable with different attachment beams in embodiments where more than one attachment beam extends from the building.

The balcony may be a balcony according to the third aspect of the second development. In these embodiments, some of the plurality of clamping mechanisms may be counterpart clamping mechanisms. Specifically, half of the plurality of clamping mechanisms may be counterpart clamping mechanisms. For example, the balcony may comprise one or more clamping sets comprising a clamping mechanism and a counterpart clamping mechanism as described in the third aspect of the second development.

By providing a balcony with a plurality of clamping mechanisms, the balcony may be attached more securely to the building, potentially via more than one attachment beam. Further, in embodiments having more than one clamping mechanism for each attachment beam, the balcony may remain attached to the building even if one of the clamps were to fail.

The floor of the balcony may comprise more apertures than total number of adjusters. Accordingly, the location of the clamps may be selected or altered without changing the floor.

A rotation of each adjuster may result in linear motion of the corresponding clamping bar. Specifically, each adjuster may engage with the corresponding clamping bar such that rotation of the adjuster results in linear motion of the corresponding clamping bar. For example, each adjuster may be a threaded shaft (e.g. a lead screw). The threaded shaft may engage with the corresponding clamping bar e.g. via an engaging hole in the clamping bar. For example, the threaded shaft may engage with a threaded hole in the corresponding clamping bar. To allow rotation of each adjuster to result in linear motion of the corresponding clamping bar, the corresponding clamping bar may be rotationally constrained. Rotation of each adjuster in a first rotational direction may result in the corresponding clamping bar moving in a first linear direction. Rotation of each adjuster in a second rotational direction, opposite to the first rotational direction, may result in the corresponding clamping bar moving in a second linear direction, opposite to the first linear direction.

In embodiments where each clamping mechanism is as described in the first aspect of the second development, the adjusters of each clamping mechanism may extend from the first housing end stop to the second housing end stop. Each adjuster may pass through each clamping arm, either via a clearance hole or via an engaging hole (e.g. a threaded hole). As such, the adjusters may limit the linear movement of each clamping arm to be along the length of the adjusters e.g. in the balcony thickness direction or in the vertical direction when the balcony is installed. Specifically, the linear movement of the first clamping arm may be limited (e.g. to vertical movement) by the adjusters. The linear movement of the second clamping arm may be limited (e.g. to vertical movement) by the adjusters.

Each adjuster may be manually operable to adjust the respective clamping bars. Each adjuster may be operable with a tool to adjust the respective clamping bars. Each adjuster may comprise a tool-engaging feature (e.g. a screw head e.g. a hexagonal ("Allen") screw head) configured to engage with the tool. The tool-engaging feature may be aligned with the corresponding aperture. Each aperture may be configured to receive the tool such that the tool can be used to operate each adjuster via the corresponding aperture to adjust the respective clamping bars.

By providing each adjuster with a tool engaging feature so that a tool can be used to operate each adjuster via the corresponding aperture to adjust the respective clamping bars, operation of the adjusters may be more easily achieved. This may reduce the installation time of the balcony. Further, a tool may be insertable into a smaller aperture than the fingers or hands of an installation worker, thus the size of the aperture may be reduced.

In a second aspect of the third development there is provided a building comprising a balcony according the first aspect of the third development, the balcony attached to the building via one or more attachment beams extending from the building.

In a third aspect of the third development there is provided a method of installing a balcony attachable to one or more attachment beams extending from a building in order to attach the balcony with respect to the building, the balcony comprising: a floor suitable for a balcony occupant to stand on; and a clamping mechanism located below the floor and engageable with an attachment beam in order to attach the balcony to the attachment beam, the clamping mechanism comprising: a clamping bar for engaging with the attachment beam; and an adjuster for adjusting the clamping bar such that the clamping bar engages with the attachment beam, wherein the floor comprises an aperture which extends through the floor in an aperture extension direction and the adjuster is aligned with the aperture such that the adjuster is accessible and operable via the aperture to adjust the clamping bar, and wherein the aperture has a first dimension perpendicular to the aperture extension direction which is between about 5 mm and about 30 mm, and wherein the aperture has a second dimension perpendicular to the first dimension and the aperture extension direction which, in the region of the aperture which has the first dimension, is between about 5 mm and about 500 mm, the method comprising the steps of: locating the balcony on the one or more attachment beams extending from the building; and operating each adjuster via the corresponding aperture in the floor so that each clamping mechanism engages with the corresponding attachment beam.

The balcony may be a balcony according to the first aspect of the third development.

The method may further comprise the step of operating one or more adjusters via the corresponding aperture(s) in the floor to operate the corresponding clamping arm(s) so that the balcony is level with the building and/or so that the balcony is a desired height from the ground.

The step of operating each adjuster via the corresponding aperture in the floor may be performed by inserting a tool engageable with each adjuster through the corresponding aperture and engaging the adjuster with the tool.

A fourth development of the present invention relates to a manner for lifting a balcony in order to position the balcony for attaching the balcony to a building.

In a first aspect of the fourth development there is provided a balcony system comprising a balcony attachable to an attachment beam extending from a building in order to attach the balcony with respect to the building, the balcony comprising: a floor suitable for a balcony occupant to stand on, and a hooking anchor located below the floor; and a hook configured to hook onto the hooking anchor to allow the balcony to be lifted, wherein the floor comprises an aperture extending through the floor in an aperture extension direction and the hooking anchor is aligned with the aperture, and wherein the aperture is configured to receive the hook such that the hook is capable of hooking onto the hooking anchor via the aperture, and wherein the aperture has a first dimension perpendicular to the aperture extension direction which is between about 5 mm and about 30 mm, and wherein the aperture has a second dimension perpendicular to the first dimension and the aperture extension direction which, in the region of the aperture which has the first dimension, is between about 5 mm and about 500 mm.

By providing a balcony system wherein the hooking anchor is aligned with the aperture, it is possible to hook the hook onto the hooking anchor without removing a part of the floor. In addition, by providing an aperture which has the first and second dimensions described above, the balcony may be safe for a user to stand on, whilst allowing the hooking anchor to be accessed. The apertures may not need to be covered when the balcony is in use. The risk to an installation worker may be reduced compared to a balcony where a part of the floor is removed to access the hooking anchor which creates a large gap or hole. There may also be reduced risk of tools or other installation debris falling through large holes or gaps in the balcony as a result of a part of the floor being removed. Furthermore, as a part of the floor does not need to be removed in order to hook the hook onto the hooking anchor, the installation time of the balcony may be reduced. The hooking anchor may be vertically aligned with the aperture i.e. the hooking anchor may be aligned in the balcony thickness direction. In other words, the aperture may be above (e.g. directly above) the hooking anchor.

The hooking anchor may be vertically aligned with the aperture i.e. the hooking anchor may be aligned in the balcony thickness direction. In other words, when the balcony is installed, the aperture may be above (e.g. directly above) the hooking anchor.

By providing a hooking anchor which vertically aligns with the aperture, the hooking anchor may be more easily accessible from above the floor.

The balcony may be a balcony according to any one of the preceding aspects/developments. Further, any feature of the preceding aspects/developments may be applicable to the balcony system of the first aspect of the fourth development. In particular, the aperture may be as described in the first aspect of the third development. For example, the aperture may be a drainage weep aperture. As another example, the aperture may be defined by one or more floor portions. Specifically, the aperture may be defined by two adjacent floor portions.

As an example of how the preceding aspects may be combined with the first aspect of the fourth development, each of the floor portions may be in abutment with adjacent floor portions.

The balcony system according to the first aspect of the fourth development may comprise: a plurality of apertures defined by the floor of the balcony, each aperture extending through the floor in a respective aperture extension direction; a plurality of hooking anchors located below the floor; and a plurality of hooks configured to hook onto respective hooking anchors to allow the balcony to be lifted, wherein each of the plurality of hooking anchors aligns with a corresponding aperture, and wherein each aperture is configured to receive one of the plurality of hooks such that each hook is capable of hooking onto a respective hooking anchor via the corresponding aperture, and wherein each aperture has a first dimension perpendicular to the respective aperture extension direction which is between about 5 mm and about 30 mm, and wherein each aperture has a second dimension perpendicular to the first dimension and the respective aperture extension direction which, in the region of the aperture which has the first dimension, is between about 5 mm and about 500 mm.

Each aperture may be the same as the aperture described above (i.e. an aperture as described in the first aspect of the third development). The balcony may comprise two, three, four, or more hooking anchors. Each hooking anchor may be as described herein. Each hooking anchor may be substantially the same. As an example, the balcony may comprise four hooking anchors, each may align with a respective one of four apertures in the floor of the balcony. The balcony system comprises the same number of hooks as hooking anchors. Each hook may be as described herein. Each hook may be substantially the same.

By providing a plurality of hooking anchors each accessible through a respective aperture in the floor, lifting equipment may be attached to multiple places on the balcony which may result in a more secure and stable lift.

The balcony may comprise a set of two or more hooking anchors. The hooking anchors of the set may be aligned in the balcony projection direction. The hooking anchors of the set may be aligned in the balcony width direction. The hooking anchors of the set may create a grid of hooking anchors. The grid may be aligned in the balcony projection direction and the balcony width direction.

By providing a set of two more hooking anchors which are aligned in a balcony projection direction or a balcony width direction, the stability of the balcony when lifted by the set of hooking anchors may be improved. In other words, the balcony may be more balanced when lifted. This may also make the balcony easier to locate on the building.

The balcony may comprise more apertures than hooking anchors. In other words, not all apertures are necessarily aligned with a hooking anchor. If the balcony comprises one or more clamping mechanisms having adjusters (fourth, sixth or first aspect of the third development), some of the apertures may ensure that the adjusters are accessible and operable from the floor. One or more apertures may serve more than one of the functions described in the present disclosure.

The balcony may have rafters as described in the first aspect of the first development. For example, each rafter may have a strengthening portion located below the floor. Each hooking anchor may be attached to a corresponding strengthening portion. More than one hooking anchor may be attached to the same strengthening portion. Each hooking anchor may comprise a shaft. The shaft may extend from the corresponding strengthening portion. The shaft may have a longitudinal shaft axis which is parallel to the balcony width direction. The shaft may pass through a hole in the strengthening portion. The shaft may be a threaded screw e.g. a cap screw. Such a shaft has a shaft diameter.

By providing a hooking anchor which is a shaft extending from a corresponding strengthening portion, the hooking anchor may be secured to a structural part of the balcony below the floor. This may improve safety when lifting the balcony via the hooking anchor and reduce the likelihood of damage to the visible parts of the balcony.

The hooking anchor may comprise a lateral constraint. The lateral constraint may be concentric with the shaft. The lateral constraint may be fixed in position with respect to the shaft. The lateral constraint may be spaced from the corresponding strengthening portion of the rafter (i.e. the strengthening portion from which the shaft extends). The lateral constraint has a lateral constraint diameter. The lateral constraint diameter may be larger than the shaft diameter. When hooked onto the hooking anchor, the hook may be laterally constrained between the lateral constraint and the corresponding strengthening portion of the rafter. The lateral constraint may be a washer. In embodiments wherein the shaft is a threaded screw, the lateral constraint may comprise a washer and a nut e.g. a lock nut.

By providing a hooking anchor with a lateral constraint, a hook used with the hooking anchor may be constrained laterally between the strengthening portion and the lateral constraint. This may ensure that the hook does not slip out of place when the balcony is being lifted.

The hooking anchor may comprise a spacer. The spacer may be concentric with the shaft. The lateral constraint may be spaced from the corresponding strengthening portion of the rafter by the spacer. The spacer has a spacer diameter. The spacer diameter may be greater than the shaft diameter. The spacer diameter may be smaller than the lateral constraint diameter. The spacer may be a washer. By providing a hooking anchor having a spacer as described above, the lateral constraint may be appropriately spaced from the corresponding strengthening portion of the rafter to receive the hook. Furthermore, the spacer may increase the diameter of the hooking anchor locally to the region where the hook will hook onto the hooking anchor, this may improve the safety of lifting the balcony via the hook (e.g. by ensuring the size of a crook portion of the hook complements the hooking anchor) and reduce the amount of material required for the hooking anchor.

The hook may comprise a stem which extends in a longitudinal direction away from the curved crook portion. The hook may have a transverse cross-sectional area, perpendicular to the longitudinal direction. The maximum transverse cross-sectional area of the hook may be smaller than a cross-sectional area of the aperture. The stem may comprise an eyelet. The eyelet may extend through the stem in a lateral direction e.g. substantially perpendicular to the longitudinal direction. When the hook is hooked onto the hooking anchor, the eyelet protrudes above the floor of the balcony. The eyelet may be used to attach conventional lifting equipment to the hook.

The hook may have a thickness in a direction perpendicular to the longitudinal direction. The thickness may be approximately equal to or less than the spacing between the lateral constraint of the hooking anchor and the corresponding strengthening portion. This ensures that the hook fits between the lateral constraint and the corresponding strengthening portion.

The balcony system may comprise one or more locking members (e.g. one locking member for each hook). Each locking member may be configured to engage with a respective hook such that movement (e.g. vertical movement) of the each hook relative to the balcony is prevented when each hook is hooked onto a respective hooking anchor.

Each hook may comprise a keyhole. Each locking member may be a locking key. Each locking key may be insertable into a respective keyhole. The stem may comprise the keyhole. The keyhole may be proximate the eyelet. The keyhole may be connected to the eyelet such that the keyhole and the eyelet form a single aperture through the hook.

The locking key may be movable from an insertion position, in which the locking key is configured to be received in the keyhole, to a locking position, in which relative motion of the corresponding hook and the balcony is prevented or at least constrained. The locking key may be rotatable from the insertion position to the locking position.

By providing a locking key movable from an insertion position to a locking positon, the hook may be more easily locked in place when hooked to the hooking anchor to improve the safety of lifting the balcony. In addition, the hook may be more easily removed when the lifting is complete so that it does not interfere with the use of the balcony.

The locking key may comprise a key bit. In the locking position, the key bit may be in contact with an upper surface of the floor of the balcony such that the corresponding hook is prevented from moving downwards (i.e. the hook is constrained from moving vertically by the key bit and the hooking anchor). By preventing each hook from moving downwards, each hook may be prevented from being unintentionally removed from the corresponding hooking anchor during lifting.

The key bit may be located on a key shaft. The key bit may extend along the length of the key shaft. In the insertion position, the key bit and key shaft are aligned with the keyhole so that the key bit and the key shaft are receivable in the keyhole. The key bit may comprise a key recess. The key recess may be located such that the key bit extends from opposite sides of the key recess along the length of the key shaft. When the locking key is in the locking position, the key recess may align with the stem of the hook such that the stem is received in the key recess. The key recess may be configured to receive the stem of the hook e.g. the internal dimension of the recess along the length of the key shaft may be greater than the thickness of the hook. The locking key may be rotated to move to the locking position.

In a second aspect of the fourth development there is provided a balcony attachable to an attachment beam extending from a building in order to attach the balcony with respect to the building, the balcony comprising: a floor suitable for a balcony occupant to stand on, and a hooking anchor located below the floor; and a hook configured to hook onto the hooking anchor to allow the balcony to be lifted, wherein the floor comprises an aperture extending through the floor in an aperture extension direction and the hooking anchor is aligned with the aperture, and wherein the aperture is configured to receive the hook such that the hook is capable of hooking onto the hooking anchor via the aperture, and wherein the aperture has a first dimension perpendicular to the aperture extension direction which is between about 5 mm and about 30 mm, and wherein the aperture has a second dimension perpendicular to the first dimension and the aperture extension direction which, in the region of the aperture which has the first dimension, is between about 5 mm and about 500 mm.

The balcony may have any of the features, either singly or in combination, of the balcony described in the balcony system of the first aspect of the fourth development. This includes any features of a balcony described in the preceding aspects/developments.

In a third aspect of the fourth development there is provided a building comprising a balcony according to the second aspect of the fourth development and an attachment beam extending from the building for supporting the balcony.

In a fourth aspect of the fourth development there is provided a method of using a balcony system, the balcony system comprising: a balcony attachable to an attachment beam extending from a building in order to attach the balcony with respect to the building, the balcony comprising: a floor suitable for a balcony occupant to stand on, and one or more hooking anchors located below the floor; and one or more hooks configured to hook onto respective hooking anchors to allow the balcony to be lifted, wherein the floor comprises one or more apertures extending through the floor in respective aperture extension directions and each hooking anchor is aligned with a respective aperture, and wherein each aperture is configured to receive a respective hook such that each hook is capable of hooking onto a respective hooking anchor via the respective aperture, and wherein each aperture has a first dimension perpendicular to the respective aperture extension direction which is between about 5 mm and about 30 mm, and wherein each aperture has a second dimension perpendicular to the first dimension and the respective aperture extension direction which, in the region of the aperture which has the first dimension, is between about 5 mm and about 500 mm, the method comprising the steps of: hooking each hook to the respective hooking anchors via the corresponding aperture in the floor; and lifting the balcony using conventional lifting equipment attached to the balcony via the hooks(s).

The balcony system may be a balcony system according to the first aspect of the fourth development.

For example, the balcony system may comprise one or more locking members configured to engage with a respective hook such that a movement of the hook relative to the balcony is prevented. In these embodiments, before the step of lifting the balcony using conventional lifting equipment attached to the balcony via the hook(s), the method comprises the further step of: engaging each locking member with the corresponding hook.

As another example, each hooking anchor may be located on a strengthening portion of a rafter and may comprise a shaft, a lateral constraint and a spacer as described in the first aspect of the fourth development. The step of hooking each hook to the respective hooking anchors via the corresponding apertures in the floor may involve hooking each hook onto the spacer of the respective hooking anchors between the lateral constraint and the strengthening portion.

A fifth development of the present invention relates to a stopper for providing a failsafe for prevention of a balcony from slidably detaching from an attachment beam.

In a first aspect of the fifth development there is provided an attachment beam extending from a building for supporting a cassette balcony, the attachment beam comprising: a stopper configured to allow the cassette balcony to slide onto the attachment beam, towards the building, the stopper comprising: a stopping face, facing the building, which is configured to abut a stopper engaging portion of the cassette balcony such that the cassette balcony is prevented from slidably detaching from the attachment beam.

The cassette balcony may comprise any of the features of a balcony described in the preceding aspects/developments. For example, the cassette balcony may comprise a clamping mechanism as described above.

By providing an attachment beam having a stopper as described above, the balcony may be prevented from sliding to a dangerous location on the attachment beam or even completely off the attachment beam. If the cassette balcony starts to move off the attachment beam i.e. away from the building, it may be obstructed by the stopping face making contact with the stopper engaging portion. This may provide a failsafe mechanism which would be most useful if the main method of securing the balcony to the attachment beam (i.e. the clamping mechanism(s)) were to fail, for example as a result of extreme or unforeseen conditions. In other words, the stopper may prevent unintentional removal of the balcony from the attachment beam. This means that the removal of the cassette balcony may require a more deliberate action e.g. by a construction worker.

The stopper may be located on a first face of the attachment beam. The stopping face may extend away from the first face of the attachment beam. The stopping face may be a flat surface. The stopper may comprise a sloping face. The sloping face may be spaced from the first face. The sloping face may be at least partly behind the stopping face (i.e. at least partly on a side of the stopping face furthest from the building). The sloping face may be completely behind the stopping face (i.e. on the side of the stopping face furthest from the building). The sloping face may extend towards the first face of the attachment beam. The sloping face may extend away from the building. In other words, the stopper may be a ratchet projection.

By providing an attachment beam having a stopper comprising a sloping face as described above, the balcony may be easier to slide along the attachment beam, over the stopper and into place. For example, a part of the balcony may engage with the sloping face so that the balcony can be slid over the stopping face and into place. In other words, the sloping face may improve the ease of installing the balcony on an attachment beam having a stopping face.

The stopping face may have an edge which is spaced furthest from the first face of the attachment beam. The sloping face may extend from the edge of the stopping face spaced furthest from the first face of the attachment beam. The sloping face may extend to the first face of the attachment beam (i.e. an edge of the sloping face may be in contact with the first face of the attachment beam).

By providing a sloping face which extends to the first face of the attachment beam, there may be a smooth transition between the sloping face and the first face of the attachment beam. This may reduce the effort required to slide the balcony over the stopper and into place on the attachment beam.

The sloping face of the stopper may have a changing gradient. The sloping face of the stopper may have a constant gradient. In other words, the stopper may be a wedge. Alternatively, the stopper may be a partial wedge.

The stopper engaging portion may be part of a clamping mechanism of the balcony. Specifically, the stopper engaging portion may be a clamping bar of the clamping mechanism. For example, the stopper engaging portion may be a clamping arm as described in the preceding aspects/developments (e.g. the first aspect of the second development).

The clamping mechanism of a cassette balcony is aligned with the attachment beam which comprises the stopper. More specifically, the clamping bar (e.g. the clamping arm) is the specific part of the clamping mechanism which will be aligned with the attachment beam. Therefore, by providing the stopper engaging portion as part of the clamping mechanism (e.g. the clamping bar), the chances of the balcony interacting with the stopping face may be improved which may improve the functionality of the stopper. In addition, there may be no need to include an extra component on the balcony to act as the stopper engaging portion which may reduce costs and manufacturing time.

The first face of the attachment beam may face an upward direction. In these embodiments, the sloping face slopes downwardly towards the first face.

By providing the first face as an upwardly facing face, gravity may be used to improve the functionality of the stopping face. For example, if the balcony (i.e. the clamping mechanism) were to fail, part of the balcony (e.g. the stopper engaging portion) may rest on the upwardly facing first face of the attachment beam as a result of gravity. Thus the chances of the stopper engaging portion interacting with the stopping face may be improved.

The attachment beam may comprises a recess. Specifically, the attachment beam may comprise a lateral recess. The lateral recess may be as described in the preceding aspects/developments (e.g. the first aspect of the second development). The lateral recess may be in a side of the attachment beam. For example, the lateral recess may extend into the attachment beam in a direction transverse (e.g. perpendicular) to the direction the attachment beam extends from the building. The lateral recess which extends into the attachment beam may also extend the along the length of the attachment beam (i.e. parallel to the direction the attachment beam extends from the building). Specifically, the lateral recess may extend along the entire length of the attachment beam (e.g. the attachment beam may be a C-beam or the attachment beam may be an I-beam). The first face (on which the stopper is located) may be a face of the recess. Specifically, the first face may be a face of the lateral recess. The first face may be an upward facing face of the recess (e.g. the lateral recess). For example, the first face may be an upward facing face of a lower flange of an I-beam.

The stopper engaging portion may project into the recess (e.g. the lateral recess). For example, the stopper engaging portion may be a clamping arm which projects into the recess (e.g. the lateral recess).

The clamping arm which projects into the recess or lateral recess may be as described in the first aspect of the second development.

By providing the stopper located on a face of a recess (e.g. a lateral recess), the stopper engaging portion will project into the recess. This may result in a more compact design compared to a stopper which is on an external face of the attachment beam. For example, the floor of the balcony may be brought closer to an upper surface of the attachment beam which may allow the balcony floor to better complement the building design and the location of the attachment beams relative to the internal floor of the building. It may also reduce the thickness of the balcony which may improve the appearance of the completed building.

The stopper may be proximate an end of the attachment beam distant from the building. The stopper may be a separate component and affixed to the attachment beam. For example, the stopper may be welded to the attachment beam. The stopper may be made from metal.

In a second aspect of the fifth development there is provided a system of attachment beams extending from a building for supporting a cassette balcony, each attachment beam being according to the first aspect of the fifth development.

By providing a system of attachment beams each being according to the first aspect of the fifth development, the balcony will be supported in multiple places. This may improve the stability of the balcony.

In a third aspect of the fifth development there is provided a balcony system comprising: a cassette balcony; and an attachment beam extending from a building for supporting the cassette balcony, wherein the attachment beam comprises: a stopper configured to allow the cassette balcony to slide onto the attachment beam, the stopper comprising: a stopping face which is configured to abut a stopper engaging portion of the cassette balcony such that the cassette balcony is prevented from slidably detaching from the attachment beam.

By providing a balcony system according to the third aspect of the fifth development, the balcony may be prevented from sliding to a dangerous location on the attachment beam or even completely off the attachment beam. If the cassette balcony starts to move off the attachment beam i.e. away from the building, it may be obstructed by the stopping face making contact with the stopper engaging portion.

The attachment beam of the balcony system may be an attachment beam according to the first aspect of the fifth development.

The balcony system of the third aspect of the fifth development may comprise a plurality of attachment beams. Each attachment beam may be an attachment beam according to the first aspect of the fifth development.

In a fourth aspect of the fifth development there is provided a building comprising a cassette balcony, the building having an attachment beam extending from the building and supporting the cassette balcony, the attachment beam comprising: a stopper configured to allow the cassette balcony to slide onto the attachment beam, towards the building, the stopper comprising: a stopping face facing the building, wherein the stopping face is aligned with a stopper engaging portion of the cassette balcony such that the stopping face prevents the cassette balcony slidably detaching from the building by abutment of the stopping face and the stopper engaging portion.

By providing a building according to the fourth aspect of the fifth development, the balcony attached to the building may be prevented from sliding to a dangerous location on the attachment beam or even completely off the attachment beam or off the building. If the cassette balcony starts to move off the attachment beam i.e. away from the building, it may be obstructed by the stopping face making contact with the stopper engaging portion.

The attachment beam used in the fourth aspect of the fifth development may be an attachment beam according to the first aspect of the fifth development.

In a fifth aspect of the fifth development there is provided a method of installing a cassette balcony to an attachment beam extending from a building, the attachment beam comprising: a stopper configured to allow the cassette balcony to slide onto the attachment beam, towards the building, the stopper comprising: a stopping face facing the building, which is configured to abut a stopper engaging portion of the cassette balcony, the cassette balcony comprising: a stopper engaging portion, the method comprising the steps of: sliding the cassette balcony along the attachment beam towards the building and over the stopper; and engaging the cassette balcony with the attachment beam such that the stopping face is aligned with the stopper engaging portion such that the stopping face prevents the cassette balcony slidably detaching from the building by abutment of the stopping face and the stopper engaging portion.

The attachment beam may be an attachment beam according to the first aspect of the fifth development.

The invention includes the combination of the, developments, aspects and preferred features described herein except where such a combination is clearly impermissible or expressly avoided. Features of the later aspects may be applicable to any conventional balcony in addition to the balconies described in the first aspect of the first development.

For example, alternatively to the first aspect of the first development, the balcony may be a conventional balcony attachable to an attachment beam extending from a building in order to attach the balcony with respect to the building, the balcony comprising: a floor; and a plurality of rafters each comprising a floor portion which defines a part of the floor, and wherein the floor portions of the rafters cooperate to define the floor. Said conventional balcony may comprise a plurality of rafters which comprise a strengthening portion. The strengthening portion may be affixed to the floor portion. However, in this implementation, the floor portion and the strengthening portions are separate components.

SUMMARY OF THE FIGURES

Embodiments illustrating the principles of the invention will now be discussed with reference to the accompanying figures in which.

DETAILED DESCRIPTION OF THE INVENTION

Developments, aspects and embodiments of the present invention will now be discussed with reference to the accompanying figures. Further aspects and embodiments will be apparent to those skilled in the art.

Figure 1:
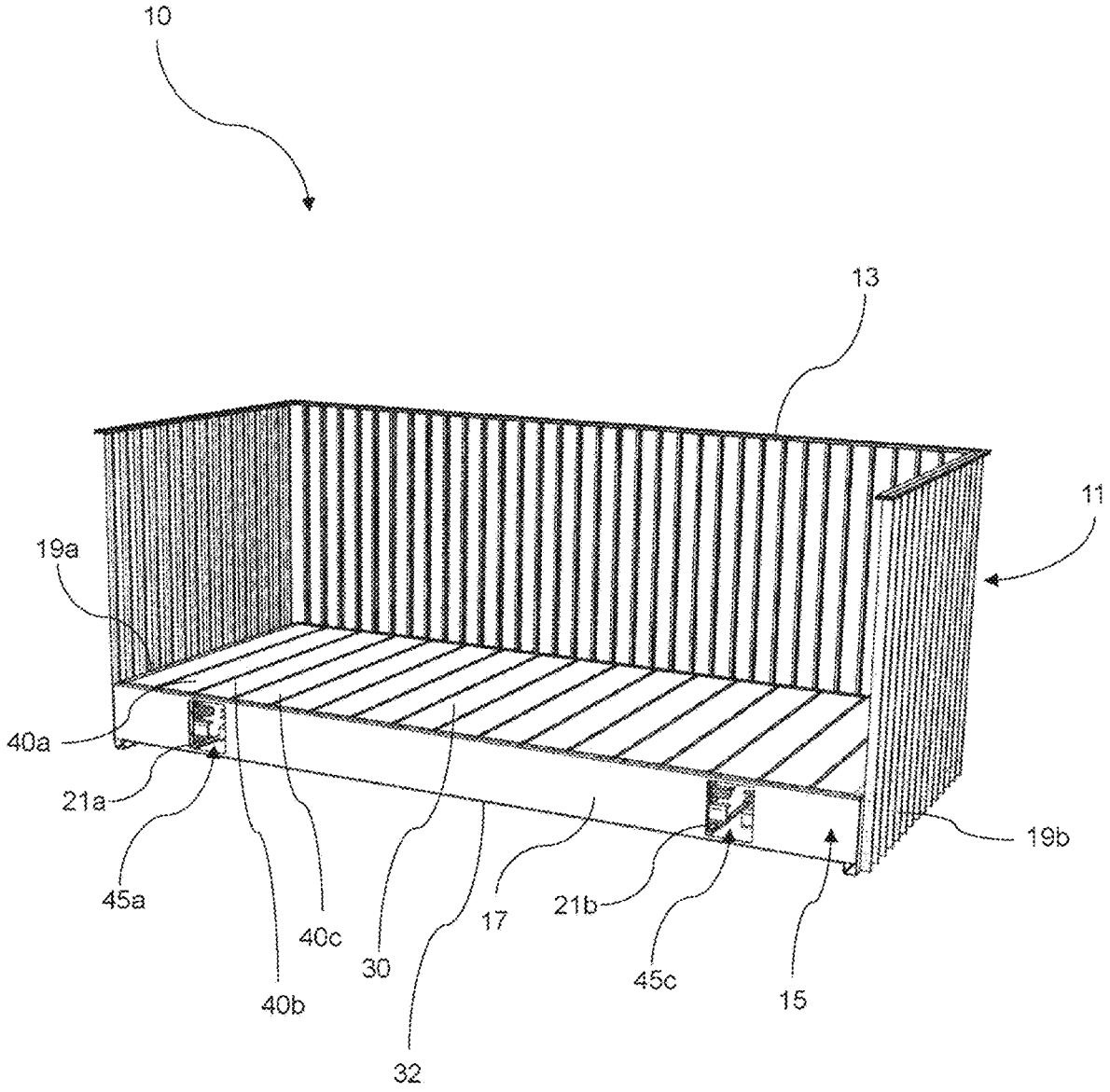
FIG. 1 is a perspective view of a balcony attachable to two attachment beams according to a first embodiment.
Figure 2:
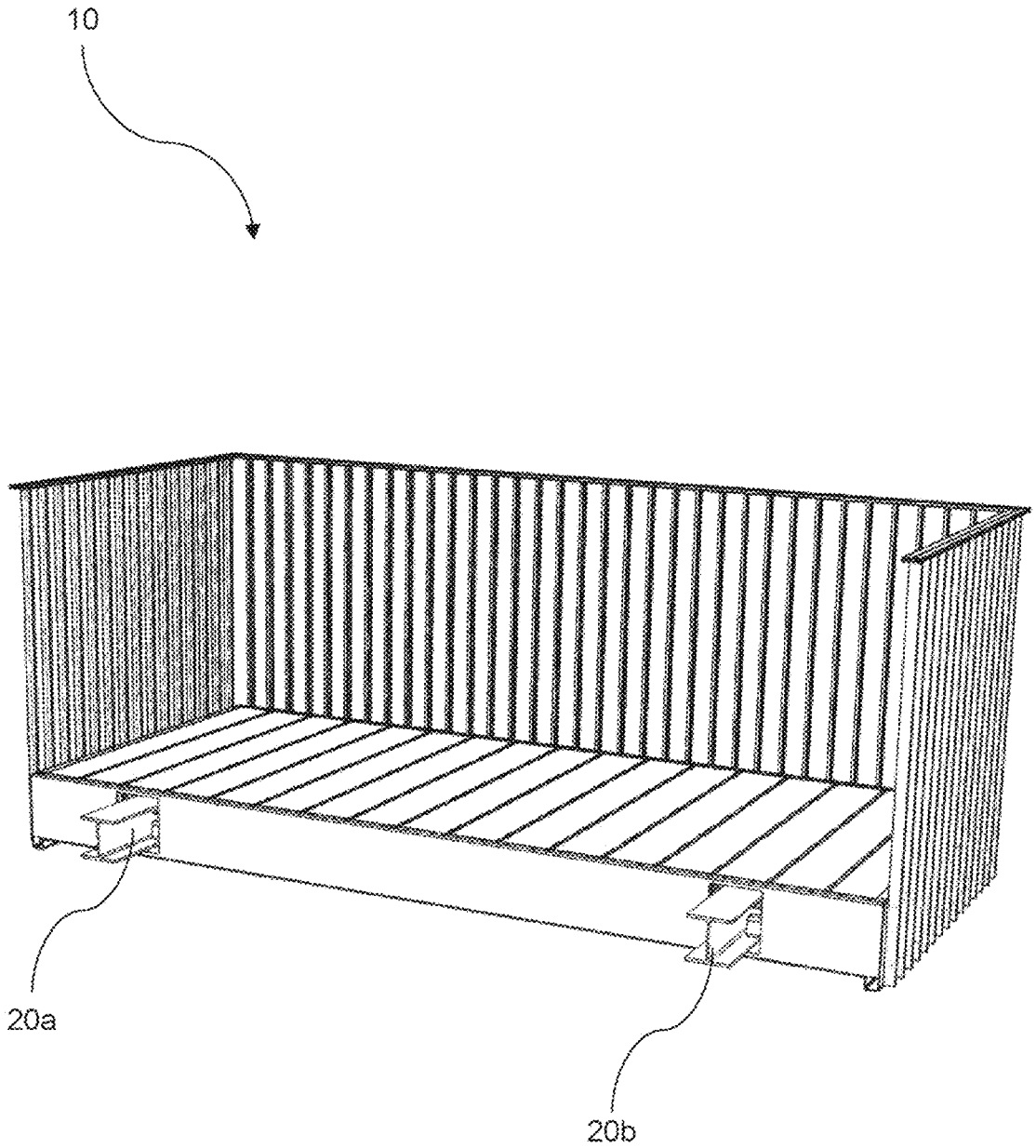
FIG. 2 is a perspective view of the balcony according to the first embodiment, attached to two attachment beams.

FIG. 1 shows a balcony 10 attachable to two attachment beams (not shown in FIG. 1) according to a first embodiment of the present invention. FIG. 2 shows the balcony 10 according to the first embodiment attached to two attachment beams 20*a*, 20*b*, extending away (into the page) from a building (not shown). Referring to FIG. 1, the balcony 10 comprises features of conventional balconies such as a plurality of balusters 11, a handrail 13 supported by the balusters (the combination forming a balustrade) and frame 15 comprising a back 17, a front (not shown), and two sides 19*a*, 19*b* which delimit the balcony 10. The balcony 10 comprises a floor 30 which provides a safe, usable surface for the end-user of the balcony 10 to stand on; and a plurality of rafters (e.g. 40*a*, 40*b*, 40*c*).

Figure 3:
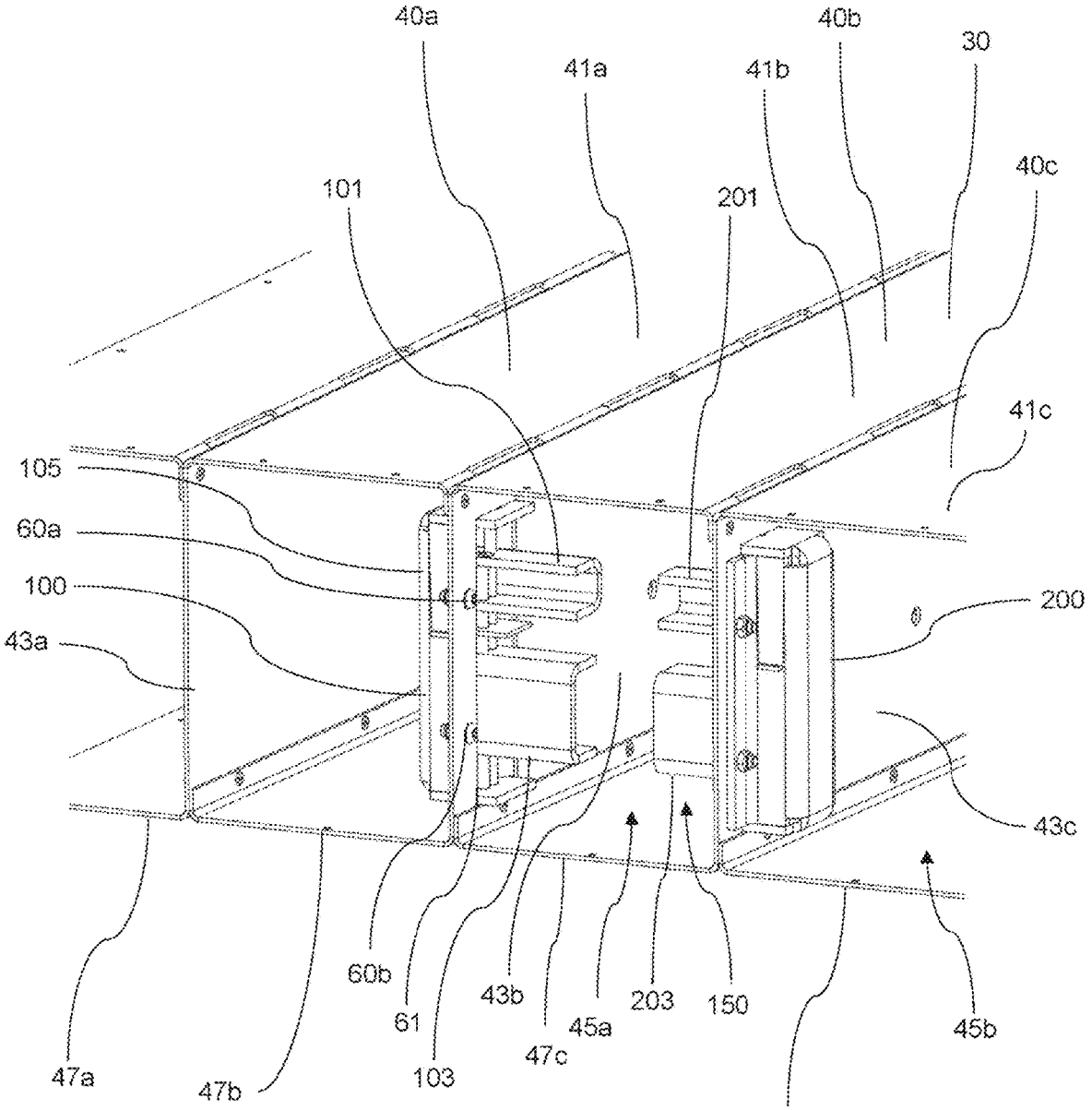
FIG. 3 is a detail perspective view of the balcony according to the first embodiment wherein a frame and balusters of the balcony are removed for simplicity.

FIG. 3 shows a close-up view the balcony 10 according to the first embodiment focussing on the region of the rafters 40*a*, 40*b*, 40*c*. The plurality of balusters 11, the handrail 13 and the frame 15 are removed from FIG. 3 for simplicity. Each rafter (e.g. 40*a*, 40*b*, 40*c*) comprises a floor portion (e.g. 41*a*, 41*b*, 41*c*) which defines a part of the floor 30, and a strengthening portion (e.g. 43*a*, 43*b*, 43*c*) which is located below the floor portion (e.g. 41*a*, 41*b*, 41*c*) and extends downwardly from the floor portion (e.g. 41*a*, 41*b*, 41*c*). The floor portions (e.g. 41*a*, 41*b*, 41*c*) of the rafters (e.g. 40*a*, 40*b*, 40*c*) cooperate to define the floor 30. Each of the rafters (e.g. 40*a*, 40*b*, 40*c*) is an integrally formed component.

In alternative embodiments (not illustrated) it is possible for only the floor portion and the strengthening portion of each rafter to be provided integrally. In that case, if a base (soffit) is provided, it may be a separate component.

Similarly, in further alternative embodiments (not illustrated) it is possible for only the base portion and the strengthening portion of each rafter to be provided integrally. In that case, separate flooring may be provided, for example in the form of decking panels. These may be laid over and attached to abbreviated forms of the illustrated floor portions. In this arrangement, certain safety advantages of the present invention are provided by the base preventing items from falling through the balcony.

The floor 30 is substantially continuous (i.e. solid). Each of the plurality of rafters (e.g. 40*a*, 40*b*, 40*c*) has a length that is parallel to the balcony projection direction (upward and to the right in FIG. 3). Each of the plurality of rafters (e.g. 40*a*, 40*b*, 40*c*) are in abutment with one or two adjacent rafters in the balcony width direction (upward and to the left in FIG. 3). For example, rafter 40*b* is in abutment with a first adjacent rafter 40*a* on a first side of rafter 40*b* in the balcony width direction and is in abutment with a second adjacent rafter 40*c* on a second side of rafter 40*b*. Specifically, each of the floor portions (e.g. 41*a*, 41*b*, 41*c*) are in abutment with one or two adjacent floor portions in the balcony width direction. For example, floor portion 41*b* is in abutment with a first adjacent floor portion 41*a* on a first side of floor portion 41*b* and a second adjacent floor portion 41*c* on a second side of floor portion 41*b*.

The strengthening portions (e.g. 43*a*, 43*b*, 43*c*) of each rafter (e.g. 40*a*, 40*b*, 40*c*) are spaced from each other in the balcony width direction by a width of a floor portion (e.g. 41*a*, 41*b*, 41*c*). Voids (i.e. cavities) (e.g. 45*a*, 45*b*) are formed between the strengthening portions (e.g. 43*a*, 43*b*, 43*c*), the floor 30 and the base 32. For example, a void 45*a* is formed between a first strengthening portion 43*b*, a second strengthening portion 43*c* adjacent to the first strengthening portion 43*b*, the floor 30 and the base 32. An attachment beam receiving aperture 21*a* (shown in FIG. 1) opens into the void 45*a*. The balcony may comprise two attachment beam receiving apertures 21*a*, 21*b* which open into respective voids 45*a*, 45*c* (best shown in FIG. 1).

The balcony base 32 is below the floor 30. The base 32 is spaced from the floor 30 by the strengthening portions (e.g. 43*a*, 43*b*, 43*c*) of the plurality of rafters (e.g. 40*a*, 40*b*, 40*c*) in the balcony thickness direction (down the page in FIG. 3). The floor 30 is intended to be horizontal. The base 32 slopes slightly with respect to the horizontal in order to provide a fall angle for drainage.

In this embodiment, each of the plurality of rafters (e.g. 40*a*, 40*b*, 40*c*) comprises a base portion (e.g. 47*a*, 47*b*, 47*c*). The base portion (e.g. 47*a*, 47*b*, 47*c*) of each rafter (e.g. 40*a*, 40*b*, 40*c*) is connected to the respective strengthening portion (e.g. 43*a*, 43*b*, 43*c*) such that the strengthening portion (e.g. 43*a*, 43*b*, 43*c*) extends upwardly from the base portion (e.g. 47*a*, 47*b*, 47*c*). The base portion (e.g. 47*a*, 47*b*, 47*c*) defines a part of the base 32. The strengthening portion (e.g. 43*a*, 43*b*, 43*c*) connects the floor portion (e.g. 41*a*, 41*b*, 41*c*) and the base portion (e.g. 47*a*, 47*b*, 47*c*) and the base portion (e.g. 47*a*, 47*b*, 47*c*) is integrally formed with the strengthening portion (e.g. 43*a*, 43*b*, 43*c*) and the floor portion (e.g. 41*a*, 41*b*, 41*c*). The base portions (e.g. 43*a*, 43*b*, 43*c*) cooperate to define the base 32.

Each base portion (e.g. 47*a*, 47*b*, 47*c*) of the plurality of rafters (e.g. 40*a*, 40*b*, 40*c*) is in abutment with one or two adjacent base portions in the balcony width direction. For example, base portion 47*b* is in abutment with a first adjacent base portion 47*a* on a first side of the base portion 47*b* and a second adjacent base portion 47*c* on a second side of the base portion 47*b*.

Figure 4:
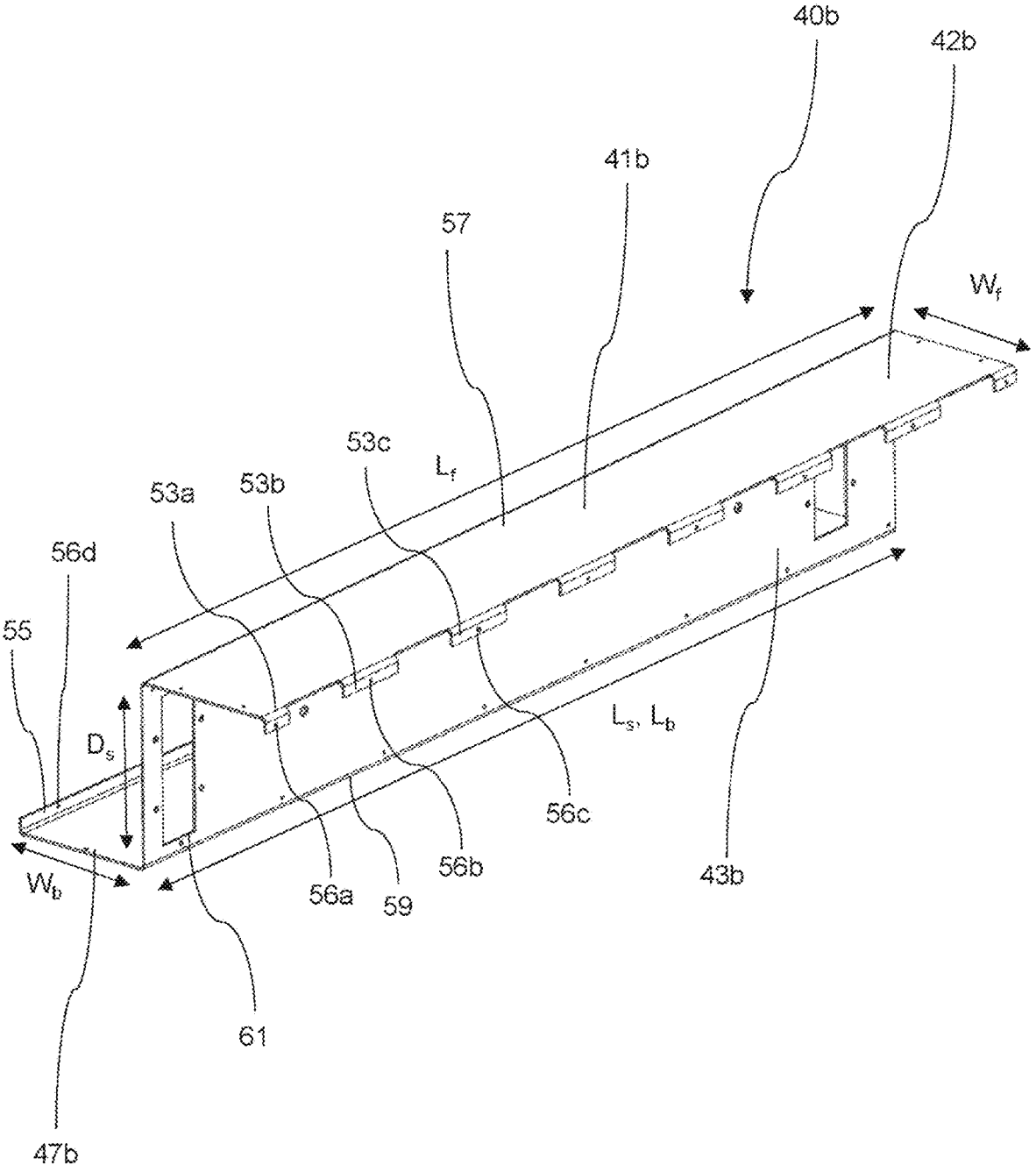
FIG. 4 is an isometric view of a single rafter which defines a part of the floor and the base of the balcony according to the first embodiment.

So that a rafter (e.g. 40*a*, 40*b*, 40*c*) can be seen in isolation, FIG. 4 shows a perspective view of a single rafter 40*b* which is shown in FIG. 3. The features of this rafter 40*b* are applicable to the other rafters (seen in FIGS. 1 and 2) which define the floor 30 and base 32 of the balcony 10. The floor portion 41*b* has a length $L_f$, a width $W_f$ perpendicular to the length $L_f$ and a uniform thickness (perpendicular to the length $L_f$ and the width $W_f$). The width $W_f$ and thickness are smaller than the length $L_f$ and the thickness is smaller than the width $W_f$. The length $L_f$ of the floor portion 41*b* is the same as the length of the rafter 40*b*, or in some embodiments slightly longer, e.g. in order to fill a gap to the building façade. A surface 42*b* of the floor portion 41*b* having width $W_f$ and length $L_f$ (i.e. with the largest surface area) defines part of an upper surface of the floor 30 when assembled (as shown in FIG. 3).

Similarly, the strengthening portion 43*b* has a length $L_s$, a depth $D_s$ perpendicular to the length $L_s$, and a uniform thickness (perpendicular to the length $L_s$ and the depth $D_s$). The depth $D_s$ and thickness are smaller than the length $L_s$ and the thickness is smaller than the depth $D_s$. In other words, the strengthening portion 43*b* is a similar shape to the floor portion 41*b* where the width $W_f$ is taken to be equivalent to the depth $D_s$. The length $L_s$ of the strengthening portion 43*b* is the same as the length $L_f$ of the floor portion 41*b*, or as noted above in some embodiments these lengths may not be identical. The strengthening portion 43*b* is at a different orientation to the floor portion 41*b*. The strengthening portion 43*b* is rotated relative to the floor portion 41*b* by an angle of about 90 degrees about an axis parallel to the length $L_s$ of the strengthening portion 43*b*. In other words, the strengthening portion 43*b* is a web extending from the floor portion 41*b* such that the depth $D_s$ of the strengthening portion 43*b* is substantially perpendicular to the width $W_f$ of the floor portion 41*b*. The depth $D_s$ varies along the length $L_s$ of the strengthening portion 43*b* such that the depth $D_s$ is greater at a front of the balcony 10 (distant from the building when the balcony 10 is attached to the building) than at a back of the balcony 10. This results in a fall angle so that the base 32 is sloped such that liquid can be drained from the balcony 10. The slope could be in another direction in order to achieve a required drainage direction, e.g. towards the building The base portion 47*b* has a length $L_b$ and a width $W_b$ perpendicular to the length $L_b$, and a uniform thickness (perpendicular to the length $L_b$ and the width $W_b$). The width $W_b$ and thickness is smaller than the length $L_b$ and the thickness is smaller than the width $W_b$. In other words, the base portion 47*b* is similar shape to the floor portion 41*b*. The length $L_b$ of the base portion 47*b* is the same as the length of the strengthening portion 43*b* and the floor portion 41*b*. As noted above, in some embodiments these length may not be identical, e.g. in order to provide space fora gutter or other drainage element adjacent the building, or to close a gap to the building façade. A face of the base portion 47*b* having width $W_b$ and length $L_b$ forms part of an upper surface of the base 47*b*. The base portion 47*b* is in the same orientation as the floor portion 41*b*.

The floor portion 41*b* and the base portion 47*b* of the rafter 40*b* are laterally offset from each other in a direction parallel to the width $W_f$ of the floor portion 41*b* (i.e. both the floor portion 41*b* and the base portion 47*b* extend away from the strengthening portion 43*b* in opposite directions). This means that the floor portion 41*b* and the base portion 47*b* are laterally offset from each other in the balcony width direction when the rafters 40*b* is assembled as part of the balcony 10, Specifically (as shown in FIG. 3), the floor portion 41*b* of the rafter 40*b* is directly above (i.e. vertically aligned with) the base portion 47*c* of the second adjacent rafter 40*c* and the base portion 47*b* of the rafter 40*b* is directly below (i.e. vertically aligned with) the floor portion 41*a* of the first adjacent rafter 40*a*. In other words, each of the rafters (e.g. 40*a*, 40*b*, 40*c*) has a Z-shaped, step-shaped or S-shaped transverse (i.e. perpendicular to the length of the rafter) cross-section.

The floor portion 41*b* of each rafter 40*b* comprises a series of floor portion castellation lips (e.g. 53*a*, 53*b*, 53*c*) to allow connection with the second adjacent rafter 40*c* (shown in FIG. 3). The base portion 47*b* of each rafter 40*b* comprises a continuous base portion lip 55 to allow connection with the first adjacent rafter 47*a* (shown in FIG. 3). Each of the floor portion lips and the base lip comprise rivet holes e.g. 56*a*, 56*b*, 56*c*, 56*d*. As shown in FIG. 3, the rivet holes (e.g. 56*a*, 56*b*, 56*c*, 56*d*) are used to allow rivets (or, in other embodiments, bolts and nuts or screws) to fix the adjacent rafters (e.g. 40*a*, 40*b*, 40*c*) together. Each of the plurality of rafters (e.g. 40*a*, 40*b*, 40*c*) are formed from a folded metal sheet having a first fold line 57 between the floor portion 41*b* and the strengthening portion 43*b* which extends the length of the rafter 40*b* and a second fold line 59 between the base portion 47*b* and the strengthening portion 43*b* which extends the length of the rafter 40*b*.

The rafters (e.g. 40*a*, 40*b*, 40*c*) which define the floor 30 and base 32 of the balcony 10 have the same structure (excluding the floor closer rafter and base closer rafter discussed below).

Figure 5:
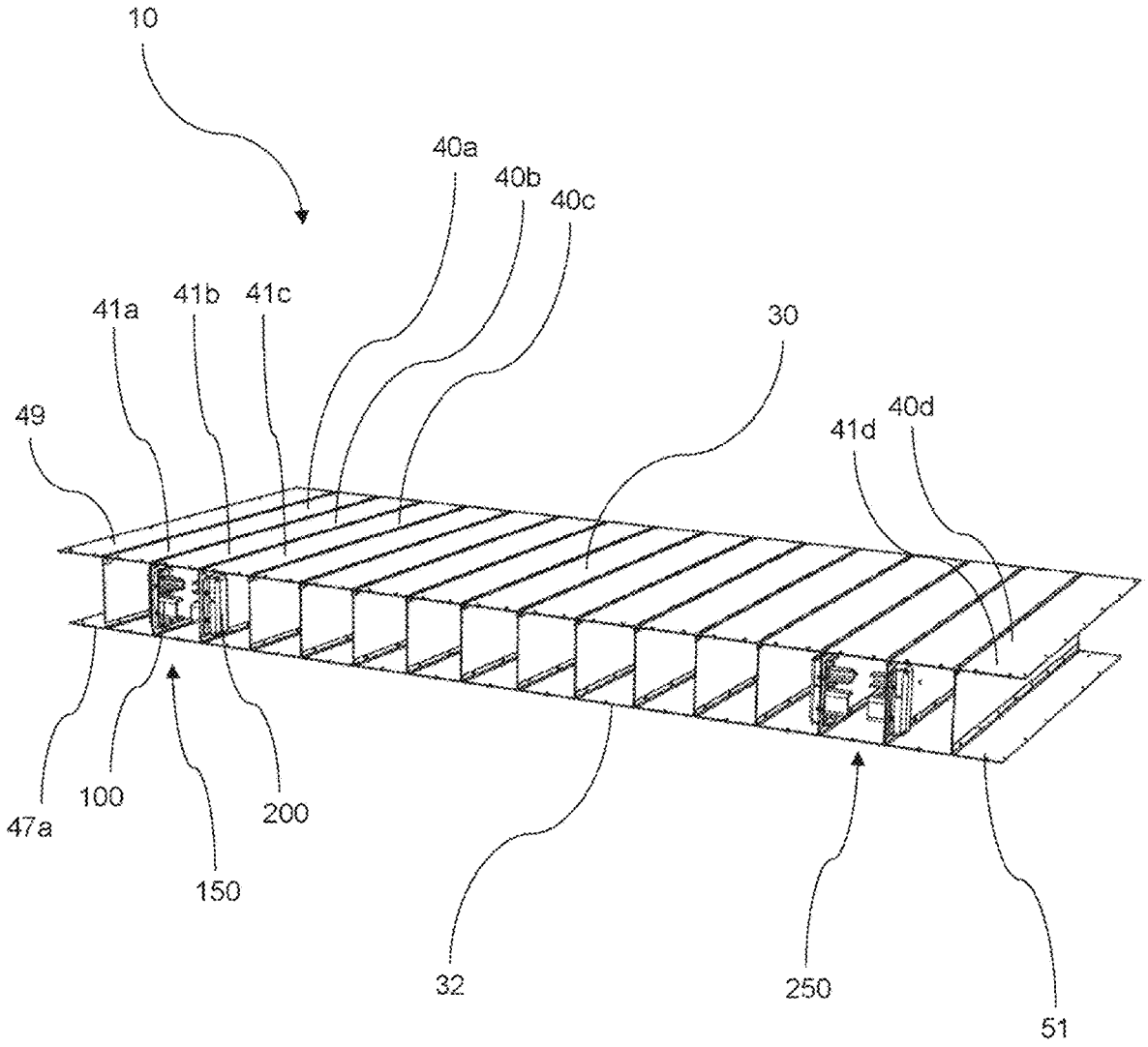
FIG. 5 is a perspective view of the balcony according to the first embodiment, the frame, balusters and handrail of the balcony have been removed.

FIG. 5 shows the balcony 10 of the first embodiment. The plurality of balusters 11, the handrail 13 and the frame 15 are removed from FIG. 5 for simplicity. The example rafters 40*a*, 40*b*, 40*c* discussed above are indicated in FIG. 5. Rafter 40*a* is at a first side of the balcony 10 in the balcony width direction (upward and to the left in FIG. 5) and rafter 40*d* is shown at a second side of the balcony 10 in the balcony width direction. Rafter 40*d* has the same structure as the rafters 40*a*, 40*b*, 40*c* described above (e.g. in FIG. 4). The floor 30 comprises a floor closer rafter 49 which has a length equal to the length of the plurality of rafters (e.g. 40*a*, 40*b*, 40*c*) described above (i.e. the same as the length $L_f$ of the floor portions (e.g. 41*a*, 41*b*, 41*c*)). The floor closer rafter 49 aligns with and is parallel to the plurality of rafters (e.g. 40*a*, 40*b*, 40*c*). The floor closer rafter 49 is at the first side of the balcony 10 in the balcony width direction. The floor closer rafter 49 accounts for the difference between the extensions of the floor 30 and the base 32 in the balcony width direction at the first side of the balcony 10. The extension of the floor 30 in the balcony width direction towards the first side of the balcony 10 is less than the extension of the base 32 in the balcony width direction towards the first side of balcony 10. This is because of the rafters (e.g. 40*a*, 40*b*, 40*c*) having a Z-shaped, step-shaped or S-shaped transverse cross-section. The floor closer rafter 49 has a width which is the same as the difference between the respective extensions of the floor 30 and the base 32 in the balcony width direction towards the first side of the balcony 10 (i.e. the width of the floor closer rafter 49 is the same as the width $W_b$ of the base portion 47*a* of the rafter 40*a* at the first side of the balcony 10).

The base 32 comprises a base closer rafter 51 which has a length equal to the length of the plurality of rafters (e.g. 40*a*, 40*b*, 40*c*) described above. The base closer rafter 51 aligns with and is parallel to the plurality of rafters (e.g. 40*a*, 40*b*, 40*c*). The base closer rafter 51 is at a second side of the balcony 10 in the balcony width direction. The base closer rafter 51 accounts for the difference between the extensions of the base 32 and the floor 30 in the balcony width direction at the second side of the balcony 10 opposite the first side of the balcony 10. The extension of the base 32 in the balcony width direction towards the second side of the balcony 10 is less than the extension of the floor 30 in the balcony width direction towards the second side of balcony 10. This is because of the rafters (e.g. 40*a*, 40*b*, 40*c*) having a Z-shaped, step-shaped or S-shaped transverse cross-section. The base closer rafter 51 has a width which is the same as the difference between the respective extensions of the base 32 and the floor 30 in the balcony width direction towards the second side of the balcony 10 (i.e. the width of the base closer rafter 51 is the same as the width $W_f$ of the floor portion 41*d* of the rafter 40*d* at the second side of the balcony 10).

Referring to FIG. 3, the balcony 10 comprises a clamping mechanism 100 located below the floor 30. The clamping mechanism 100 is engageable with an attachment beam 20*a* (shown best in FIG. 6 and FIG. 10).

Figure 6:
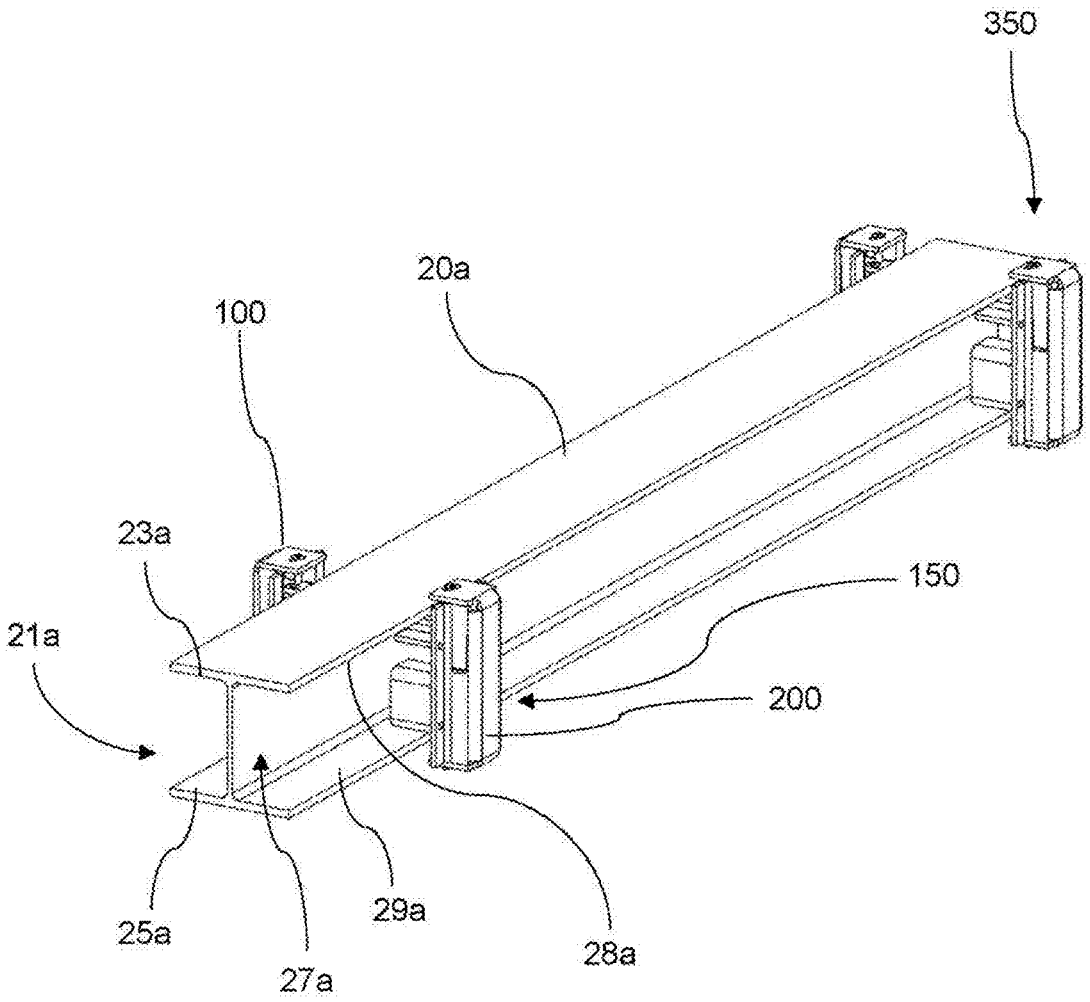
FIG. 6 is a perspective view of one of the attachment beams used with the first embodiment and also shows how the clamping sets of the balcony are located on the attachment beam.

FIG. 6 shows the attachment beam 20*a* and the clamping sets 150, 350 (discussed later) of the balcony engaged with the attachment beam 20*a*, the rest of the balcony 10 is removed for clarity. In this embodiment, the attachment beam is an I-beam. The clamping mechanism 100 is part of the clamping set 150. The attachment beam 20*a* has a lateral recess 21*a* on a first side of the attachment beam 20*a* comprising a first surface 23*a* and a second surface 25*a* facing the first surface 23*a*. The lateral recess 21*a* extends into the attachment beam 20*a* perpendicular to the direction the attachment beam 20*a* extends (upward and to the right in FIG. 6) from the building (not shown). The lateral recess 21*a* also extends the entire length of the attachment beam 20*a* (i.e. parallel to the direction the attachment beam 20*a* extends from the building (not shown)). The attachment beam has a counterpart lateral recess 27*a* on a second side of the attachment beam 20*a* opposite the first side of the attachment beam 20*a*. The counterpart lateral recess 27*a* comprises a first counterpart surface 28*a* and a second counterpart surface 29*a* facing the first counterpart surface 28*a*. The counterpart lateral recess 27*a* extends into the attachment beam 20*a* perpendicular to the direction the attachment beam 20*a* extends from the building (not shown). The counterpart lateral recess 28*a* also extends the entire length of the attachment beam 20*a* (i.e. parallel to the direction the attachment beam 20*a* extends from the building (not shown)).

The balcony 10 is attached to two attachment beams 20*a*, 20*b* (see FIG. 2) which extend from the building (not shown). The attachment beam 20*b* is not described here in detail for brevity but has the same structure and function as described herein regarding the attachment beam 20*a*. In other embodiments, there may be more than two attachment beams, e.g. three or more.

Figure 7:
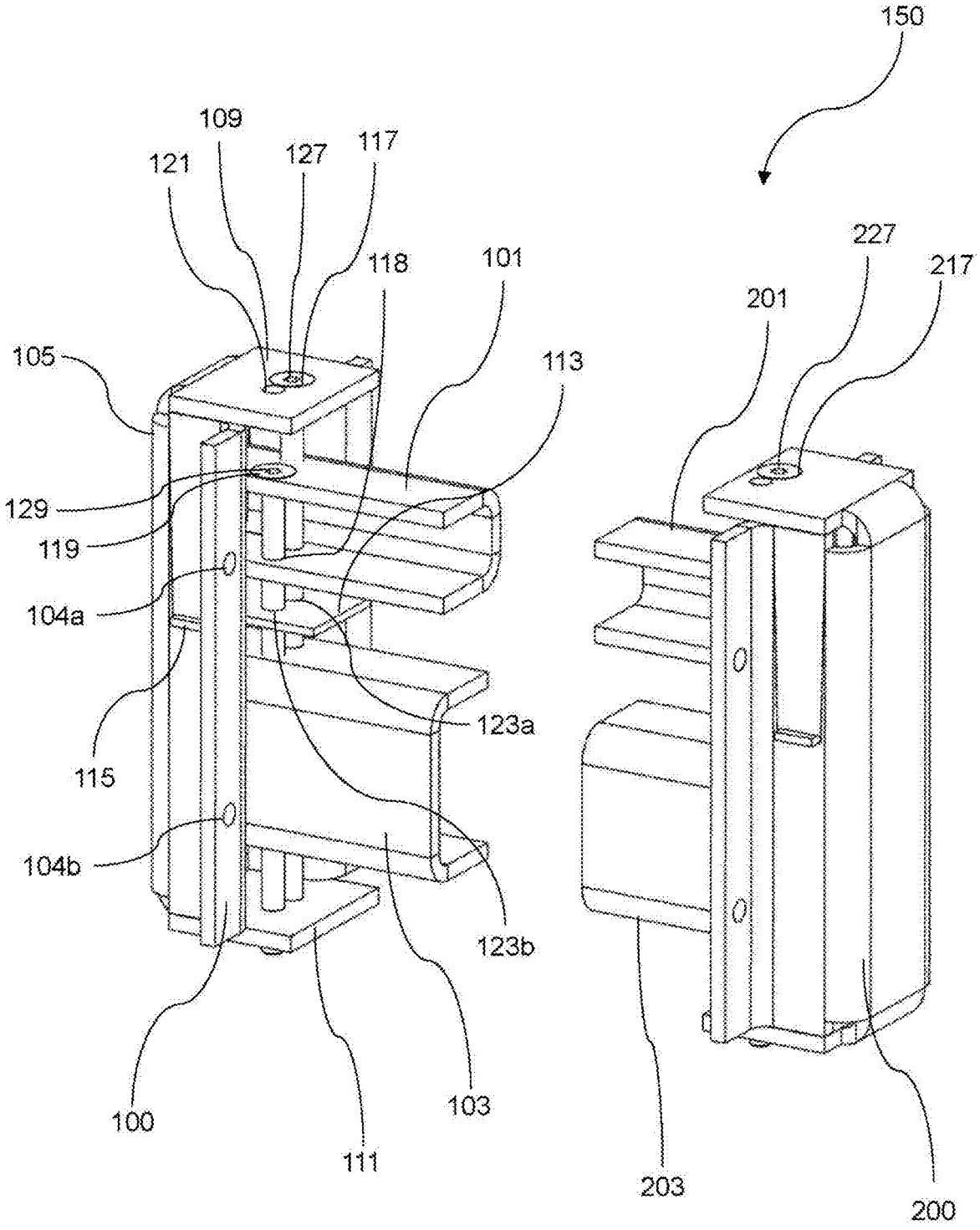
FIG. 7 is a detail perspective view of one of the clamping sets of the balcony according to the first embodiment in isolation.

FIG. 7 shows the clamping set 150 (discussed later) in isolation which comprises the clamping mechanism 100. The clamping mechanism 100 comprises a first adjustable clamping arm 101 for engaging with the attachment beam 20*a*; and a second adjustable clamping arm 103 spaced from the first clamping arm 101 in a clamping arm spacing direction (downward in FIG. 7) for engaging with the attachment beam 20*a*. The first and second clamping arms 101, 103 are configured to engage with the attachment beam 20*a* by applying pressure respectively to the first surface 23*a* and to the second surface 25*a* of the lateral recess 21*a*. The lateral recess 21*a* is configured to receive the first and second clamping arms 101, 103.

The positions of the first and second clamping arms 101, 103 are independently adjustable. In other words, the location of the first clamping arm 101 relative to the balcony 10 is changeable without changing the location of the second clamping arm 103 relative to the balcony 10. Similarly, the location of the second clamping arm 103 relative to the balcony 10 is changeable without changing the location of the first clamping arm 101 relative to the balcony 10.

The first clamping arm 101 is aligned with the second clamping arm 103 in the clamping arm spacing direction. The clamping arm spacing direction is parallel to the balcony thickness direction (i.e. the first clamping arm 101 and the second clamping arm 103 are vertically aligned).

The clamping mechanism comprises a housing 105. The first clamping arm 101 extends from the housing 105 and the second clamping arm 103 extends from the housing 105.

Best shown in FIG. 3, the clamping mechanism 100 is located between the floor 30 and the base 32. The clamping mechanism 100 is fixed to the first strengthening portion 43*b*. This is achieved using fasteners (e.g. 60*a*, 60*b*) respectively passed through the clamping mechanism attachment holes (e.g. 104*a*, 104*b*), best shown in FIG. 7. The first and second clamping arms 101, 103 extend away from the first strengthening portion 43*b*. Specifically, the housing 105 of the clamping mechanism 100 is fixed to the first strengthening portion 43*b*. The first and second clamping arms 101, 103 extend into the void 45*a* between the first strengthening portion 43*b* and the adjacent second strengthening portion 43*c*. The first strengthening portion 43*b* to which the clamping mechanism 100 is attached comprises an aperture 61 (also shown in FIG. 4). The housing 105 of the clamping mechanism 100 is fixed over the aperture 61. The first and second clamping arms 101, 103 extend through the aperture 61 into the void 45*a* between the two strengthening portions 43*b*, 43*c*. This means that the housing 105 is fixed to the first strengthening portion 43*b* on a side of the first strengthening portion 43*b* outside the void 45*a* between the two strengthening portions 43*b*, 43*c*.

Referring to FIG. 7, the movement of the first clamping arm 101 is limited by a first housing end stop 109 at one end of the housing 105 in the vertical direction (i.e. the balcony thickness direction). The first housing end stop 109 extends in the same direction as the first clamping arm 101 extends from the housing 105. The first housing end stop 109 is configured to abut the first clamping arm 101 such that the first clamping arm 101 cannot move past the first housing end stop 109 (in a direction away from the second clamping arm 103).

The movement of the second clamping arm 103 is limited by a second housing end stop 111 at an end of the housing 105 opposite the first housing end stop 109. The second housing end stop 111 extends in the same direction as the second clamping arm 103 extends from the housing 105. The second housing end stop 111 is configured to abut the second clamping arm 103 such that the second clamping arm 103 cannot move past the second housing end stop 111 (in a direction away from the first clamping arm 101).

The clamping mechanism 100 comprises a stiffener 113 located between the first and second clamping arms 101, 103. The stiffener 113 is fixed relative to the housing 105 in the balcony thickness direction. The stiffener 113 is fixed using two tabs (e.g. 115) which pass through the housing 105 such as the tab 115 (another tab passes through the housing on the opposite side to the tab 115 but is not shown in FIG. 7). The stiffener 113 limits the movement of the first clamping arm 101 in a direction opposite the direction limited by the first housing end stop 109. The stiffener 113 is configured to abut the first clamping arm 101 such that the first clamping arm 101 cannot move past the stiffener 113 (in a direction towards the second clamping arm 103). In other words, at the extremities of the first clamping arm 101 movement, the first clamping arm 101 abuts either the first housing end stop 109 or the stiffener 113.

The stiffener 113 also limits the movement of the second clamping arm 103 in a direction opposite the direction limited by the second housing end stop 111. The stiffener 113 is configured to abut the second clamping arm 103 such that the second clamping arm 103 cannot move past the stiffener 113 (in a direction towards the first clamping arm 101). In other words, at the extremities of the second clamping arm 103 movement, the second clamping arm 103 abuts either the second housing end stop 111 or the stiffener 113.

The clamping mechanism 100 comprises two adjusters 117, 119. The first clamping arm 101 is adjustable by a first adjuster 117 and the second clamping arm 103 is adjustable by a second adjuster 119. Although the first adjuster 117 is used to adjust the first clamping arm 101 and the second adjuster 119 is used to adjust the second clamping arm 103, both adjusters 117, 119 pass through both clamping arms 101, 103. The first adjuster 117 extends from the first housing end stop 109 to the second housing end stop 111 and the second adjuster 119 extends from the top of the first clamping arm 101 and towards and through the second housing end stop 111. Consequently, the rotational movement of the first clamping arm 101 about a vertical axis is prevented by the adjusters 117, 119 which pass through the first clamping arm 101. Similarly, the rotational movement of the second clamping arm 103 about a vertical axis is prevented by the adjusters 117, 119 which pass through the second clamping arm 103. Thus the first clamping arm 101 and the second clamping arm 103 are constrained to vertical movement only.

The adjusters 117, 119 are rotatable, which results in linear motion of the corresponding clamping arms 101, 103. For example a rotation of the first adjuster 117 of the clamping mechanism 100 results in linear motion of the clamping arm 101. The first adjuster 117 is a lead screw, the threaded part of which engages with the first clamping arm 101 via a first threaded hole 125 in the first clamping arm 101. The second adjuster 119 is a lead screw, the threaded part of which engages with the second clamping arm 103 via a second threaded hole 126 in the second clamping arm 103. Rotation of the first adjuster 117 in a first rotational direction results in the first clamping arm 101 moving in a first linear direction (up the page in FIG. 7). Rotation of the second adjuster 119 in a first rotational direction results in the second clamping arm 103 moving in the first linear direction. Rotation of the first adjuster 117 in a second rotational direction results in the first clamping arm 101 moving in a second linear direction (down the page in FIG. 7). Rotation of the second adjuster 119 in a second rotational direction results in the second clamping arm 103 moving in the second linear direction.

It is possible to select the handedness of the threads of the first and second adjusters, and the corresponding threads of the first and second clamping arms. For example, the threads may be selected so that clockwise rotation of each adjuster results in tightening of each clamping arm against the respective face of the attachment beam. Typically this would require that the threads of the first and second adjusters are opposite to each other.

The first clamping arm 101 comprises a first clearance hole 118, which is a through hole in the first clamping arm 101 and is not threaded. The second adjuster 119 which adjusts the second clamping arm 103 passes through the first clearance hole 118 so that the second adjuster 119 does not engage with the first clamping arm 101. The second clamping arm 103 comprises a second clearance hole 120, which is a through hole in the second clamping arm 103 and is not threaded. The first adjuster 117 which adjusts the first clamping arm 101 passes through the second clearance hole 120 so that the first adjuster 117 does not engage with the second clamping arm. The first housing end stop 109 is provided with an access hole 121. The access hole 121 allows the second adjuster 119 to be accessible to and operable with a tool to adjust the second clamping arm 103. Because the stiffener 113 is located between the first and second clamping arms 101, 103, the stiffener 113 comprises two stiffener clearance holes 123*a*, 123*b*. The respective adjusters 117, 119 pass through the respective stiffener clearance holes.

The adjusters 117, 119 are operable with a tool (not shown) to adjust the respective clamping arms 101, 103. The first adjuster 117 comprises a first tool-engaging feature which is a hexagonal screw head 127 configured to engage with the tool. The second adjuster 119 comprises a second tool-engaging feature which is a hexagonal screw head 129 configured to engage with the tool.

The first and second clamping arms 101, 103 have a C-shaped transverse cross-sectional shape i.e. transverse to the direction of extension of the respective clamping arms 101, 103.

As can be seen in e.g. FIG. 3, FIG. 5 and FIG. 6, the balcony comprises a clamping set 150, shown in detail in FIG. 7. The clamping set 150 comprises: the clamping mechanism 100 engageable with the attachment beam as described above; and a counterpart clamping mechanism 200 engageable with the attachment beam 20*a*. The counterpart clamping mechanism 200 comprises: a first counterpart adjustable clamping arm 201 for engaging with the attachment beam 20*a*; and a second counterpart clamping arm 203 spaced from the first counterpart clamping arm 201 for engaging with the attachment beam 20*a*. The first and second counterpart clamping arms 201, 203 are configured to engage with the attachment beam 20*a* by applying pressure respectively to the first counterpart surface 28*a* and the second counterpart surface 29*a* of the counterpart lateral recess 27*a*. The counterpart lateral recess 27*a* is configured to receive the first and second counterpart clamping arms 201, 203. The counterpart clamping mechanism 200 is spaced from and aligned with the clamping mechanism 100 in a balcony width direction (best shown in FIG. 3).

Note that the clamping mechanism and the counterpart clamping mechanism are not necessarily mirror symmetrical (although in some embodiments they may be). In the present embodiment, because the adjustment aperture is formed slightly offset from the interface between adjacent rafters, the adjusters are positioned appropriately with respect to the end stop 109. Accordingly, the position of the adjusters with respect to the end stop of the clamping mechanism 100 is not the same as the position of the adjusters with respect to the end stop of the counterpart clamping mechanism 200.

The counterpart clamping mechanism 200 comprises all the features of the clamping mechanism 100 described above. For example, the counterpart clamping mechanism 200 comprises adjusters (also referred to as counterpart adjusters). For example, the counterpart clamping mechanism comprises a first counterpart adjuster 217 having a first counterpart tool-engaging feature 227 and a second counterpart adjuster 219 having a second tool-engaging feature 229 (visible in FIG. 11).

FIG. 3 shows the clamping set 150 in position in the balcony 10. The first and second counterpart clamping arms 201, 203 extend towards the clamping mechanism 100 and the first and second clamping arms 101, 103 extend towards the counterpart clamping mechanism 200. The counterpart clamping mechanism 200 is fixed to an adjacent (second) strengthening portion 43*c* to the first strengthening portion 43*b* to which the clamping mechanism 100 is fixed. The counterpart clamping mechanism 200 is fixed to the second strengthening portion 43*c* in similar way to the way that the clamping mechanism 100 is fixed to the first strengthening portion 43*b*. Thus the first and second clamping arms 101, 103 and the first and second counterpart clamping mechanisms 201, 203 extend towards each other into the void 45*a* between the strengthening portions 43*b*, 43*c*.

Figure 8:
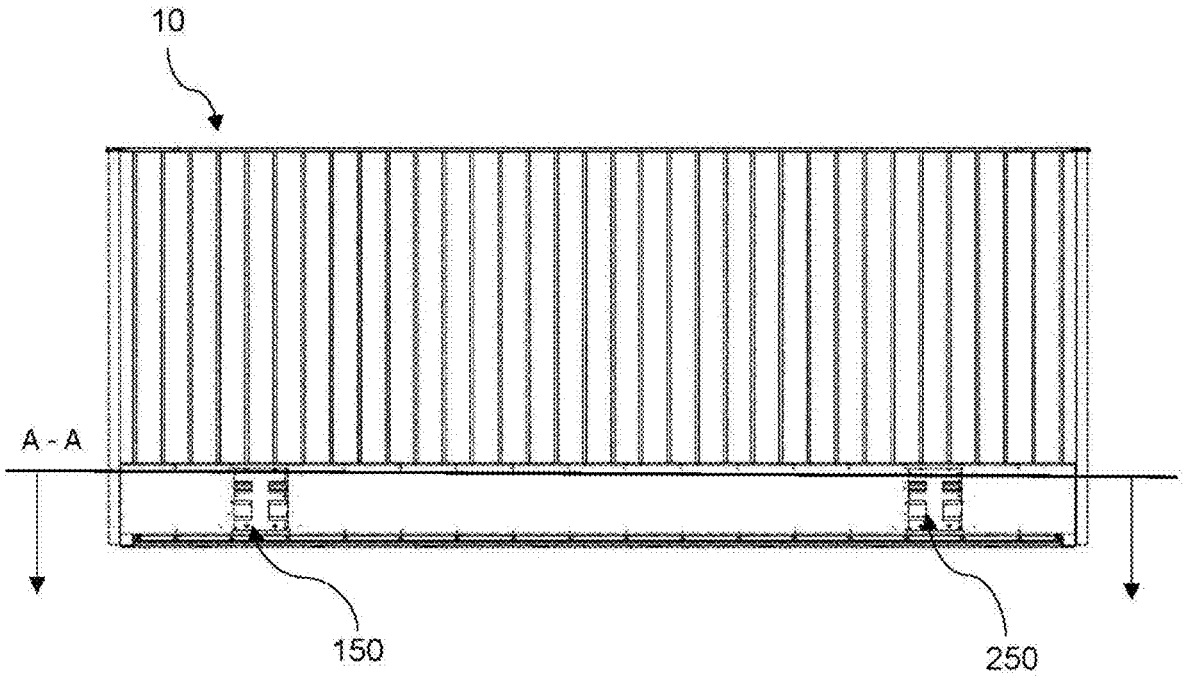
FIG. 8 is a back view the balcony according to the first embodiment showing the section line A-A.
Figure 9:
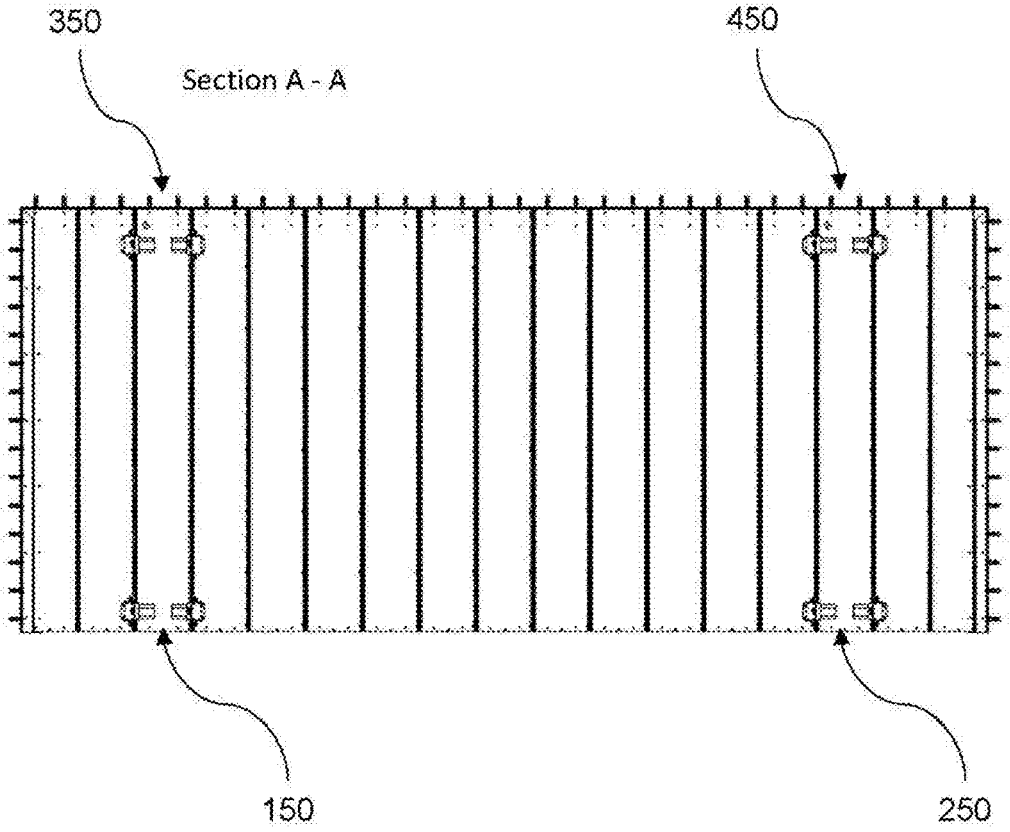
FIG. 9 is a section view of the balcony according to the first embodiment viewed from the section line shown in FIG. 8.

The balcony 10 comprises a four clamping sets as described above, these are best shown in FIG. 9, which shows a section view of the balcony 10 (located as shown in FIG. 8) and the clamping sets 150, 250, 350, 450. Two clamping sets 150, 350 are aligned in the balcony projection direction and engage with the attachment beam 20*a* in the manner described above for the clamping set 150. The other two clamping sets 250, 450 are aligned in the balcony projection direction and engage with the other attachment beam 20*b*. The plurality of clamping sets 150, 250, 350, 450 form a grid of clamping sets aligned in the balcony width direction and the balcony projection direction.

Figure 10:
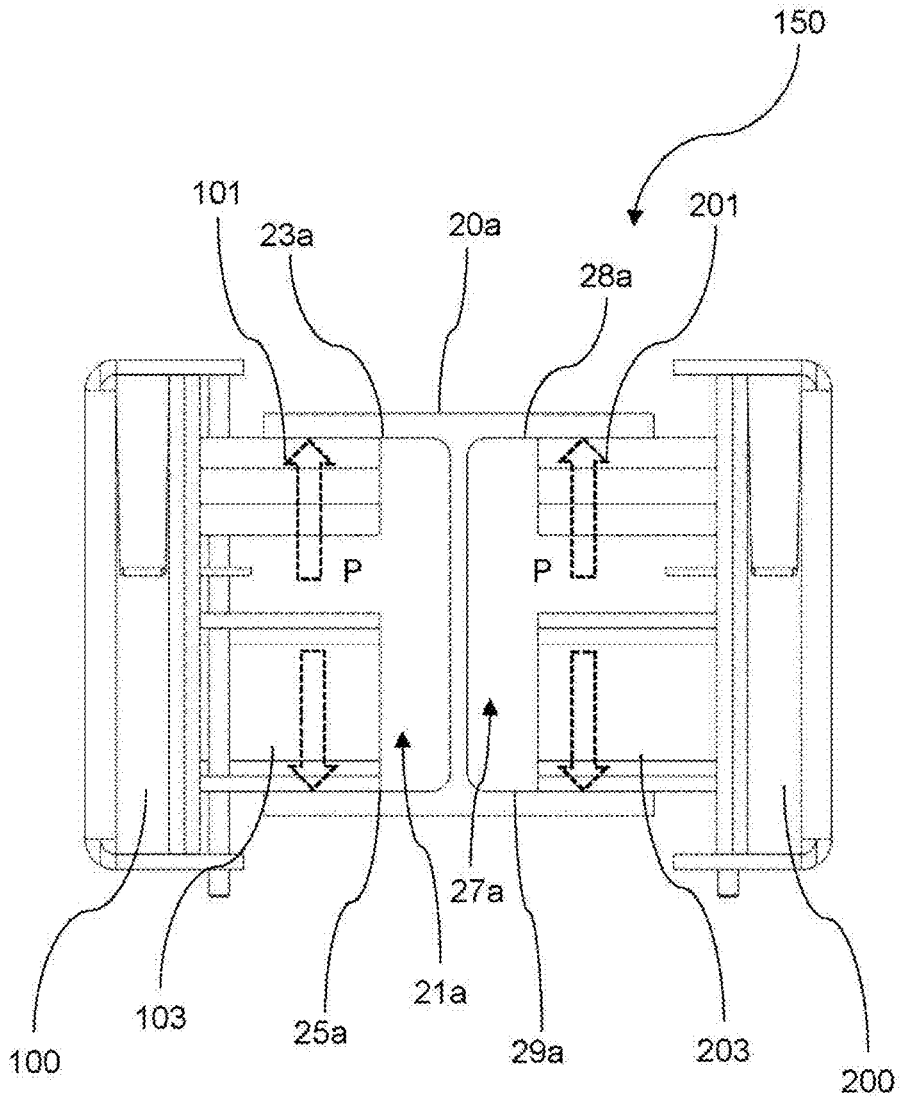
FIG. 10 is a back view of a clamping set of the balcony attached to an attachment beam according to the first embodiment. The direction of applied pressure is shown in FIG. 10.

FIG. 10 shows a back view of the clamping set 150, comprising the clamping mechanism 100 and the counterpart clamping mechanism 200, attached to the clamping beam 20*a*. The rest of the balcony 10 is removed from FIG. 10 for clarity. To install the balcony 10, the balcony 10 is first located on the attachment beams 20*a*, 20*b* (see FIG. 2). When located on the balcony, the second clamping arm 103 and the second counterpart clamping arm 203 of the clamping set 150 respectively rest on the second surface 25*a* of the lateral recess 21*a* and the second counterpart surface 29*a* of the counterpart lateral recess 27*a* (see also FIG. 6). Further, the clamping arms of the other clamping sets 250, 350, 450 which correspond to the second clamping arm 103 and the second counterpart clamping arm 203, also rest on surfaces corresponding to the second surface 25*a* of the lateral recess 21*a* and the second counterpart surface 29*a* of the counterpart lateral recess 27*a* on respective attachment beams 20*a*, 20*b*.

Next, to secure the balcony 10 to the attachment beams 20*a*, 20*b*, the first clamping arm 101 and the first counterpart clamping arm 201 are adjusted so that they respectively engage with the first surface 23*a* and first counterpart surface 28*a* of the attachment beam 20*a*. Pressure (a representation of which is shown by the thick arrows in FIG. 10) is applied to the attachment beam at the regions of contact with the clamping set 150. Further, the clamping arms of the other clamping sets 250, 350, 350 which correspond to the first clamping arm 101 and the first counterpart clamping arm 201 are similarly adjusted.

In addition, any of the clamping arms or counterpart clamping arms (e.g. 101, 103, 201, 203) of any of the clamping sets 150, 250, 350, 450 can be independently adjusted so that the balcony is level with the building and/or so that the balcony is a desired height from the ground.

Figure 11:
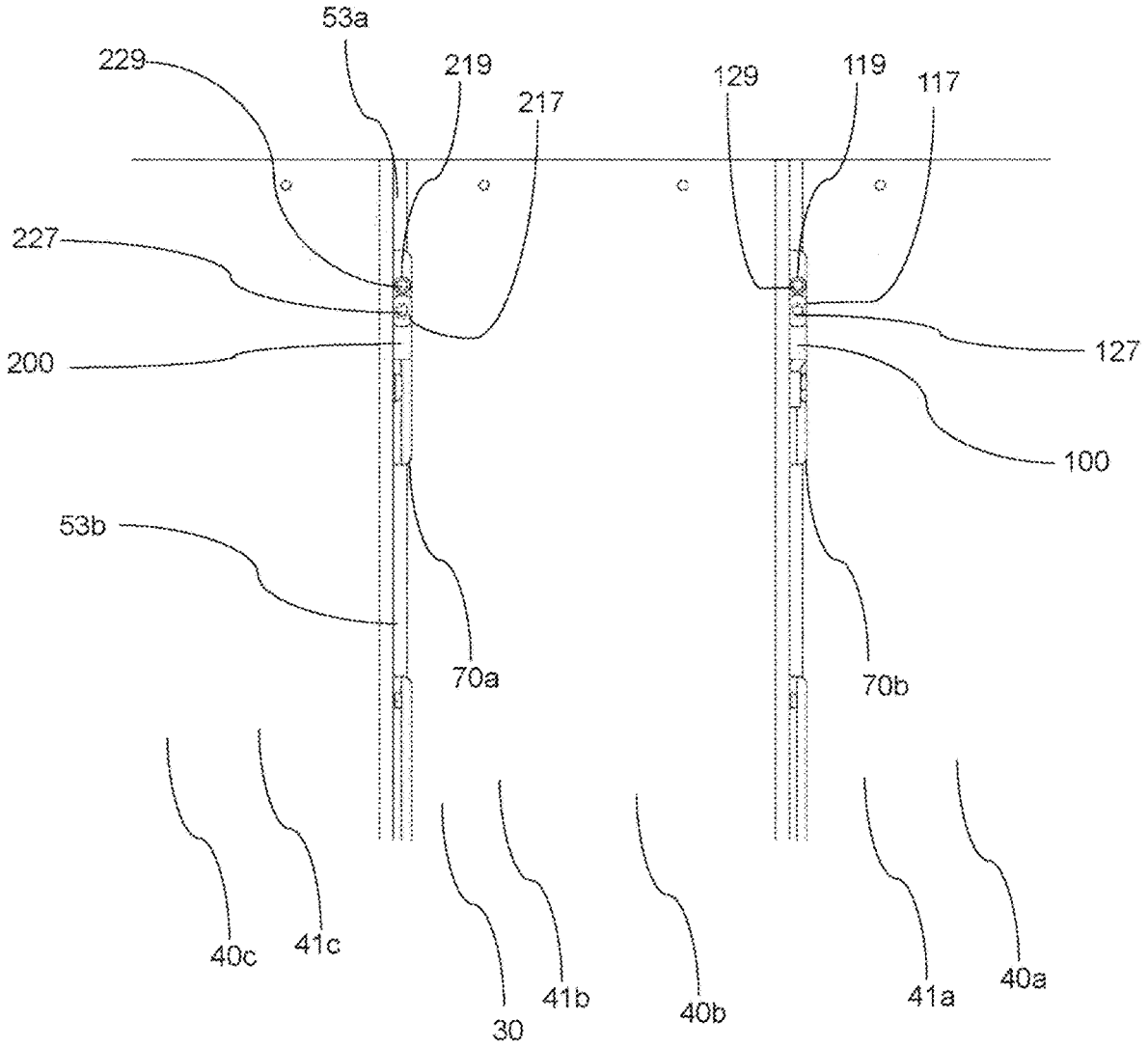
FIG. 11 shows a partial top view at the back of the balcony 10 with the frame and balusters removed.

FIG. 11 shows a partial top view of the balcony 10, the view being aligned with the clamping set 150. The floor 30 comprises a plurality of apertures (e.g. 70*a*, 70*b*) which extend through the floor in an aperture extension direction parallel to the balcony thickness direction. As can be seen in FIG. 1 and FIG. 2, the balcony 10 comprises many more apertures than the example apertures (70*a*, 70*b*) shown in FIG. 11. The adjusters 117, 119 of the clamping mechanism 100 are vertically aligned with a first aperture 70*b* and counterpart adjusters 217, 219 of the counterpart clamping mechanism 200 are vertically aligned with a second aperture 70*a*. This means that the adjusters 117, 119 of the clamping mechanism 100 are accessible and operable to adjust the clamping arms (not visible in FIG. 11) via the first aperture 70*b* and the counterpart adjusters 217, 219 of the counterpart clamping mechanism 200 are accessible and operable to adjust the counterpart clamping arms (not visible in FIG. 11) via the second aperture 70*a*. Each aperture (e.g. 70*a*, 70*b*) which extends through the floor 30 has a first dimension parallel to the balcony width direction (across the page in FIG. 11) which is about 9 mm and a second dimension, perpendicular to the first dimension and parallel to the balcony projection direction (up the page in FIG. 11), which is about 108 mm in the region of the aperture (e.g. 70*a*, 70*b*) which has the first dimension. Accordingly, the area of the aperture is about 972 $mm^2$.

All of the apertures (e.g. 70*a*, 70*b*) in the floor 30 are drainage weep apertures which allow liquid to drain off the floor 30 of the balcony.

The apertures (e.g. 70*a*, 70*b*) are defined by two adjacent floor portions (e.g. 41*a*, 41*b*, 41*c*) of the rafters (e.g. 40*a*, 40*b*, 40*c*). The floor portion lips (e.g. 53*a*, 53*b*, 53*c*) partly define the apertures (e.g. 70*a*, 70*b*). For example, the aperture 70*a* is partly defined by the floor portion 41*b* and the floor lip portions 53*a*, 53*b* (see also FIG. 4) of the rafter 40*b*. Additionally, one edge of the aperture 70*a* is defined by the floor portion 41*c* of the second adjacent rafter 40*c*. All of the apertures (e.g. 70*a*, 70*b*) in the floor 30 are defined in this way.

All the apertures (e.g. 70*a*, 70*b*) in the floor 30 are elongate (i.e. slots) which extend in the balcony projection direction (up the page in FIG. 10). Because the apertures (e.g. 70*a*, 70*b*) are slots, the adjusters 117, 119 and the counterpart adjusters 217, 219, which are respectively spaced laterally in the balcony projection direction, are easily accessible and operable to adjust the clamping arms (not visible in FIG. 11) and the counterpart clamping arms (not visible in FIG. 11).

The other clamping sets 250, 350, 450 which are in the balcony 10 are arranged in the same way as described above, such that the respective adjusters and counterpart adjusters of the clamping sets 250, 350, 450, which correspond to the adjusters 117, 119 and counterpart adjusters 217, 219 of the clamping set 150, are aligned with apertures (identical to apertures 70*a*, 70*b*) such that the respective adjusters and counterpart adjusters are accessible and operable to adjust the respective clamping arms of the other clamping sets 250, 350, 450. Note that the floor 30 of the balcony 10 comprises more apertures than required for the clamping sets 150, 250, 350, 450 to be arranged as described above (best shown in FIG. 1 and FIG. 2).

So that the adjusters (e.g. 117, 119) and counterpart adjusters (e.g. 217, 219) are operable to adjust the corresponding clamping arms (e.g. 101, 103) and counterpart clamping arms (e.g. 201, 203), the tool-engaging features (e.g. 127, 129, 227, 229) are aligned with respective apertures (e.g. 70*a*, 70*b*). Accordingly, when installing the balcony 10 on the attachment beams 20*a*, 20*b* as described above, a tool is inserted into the apertures (e.g. 70*a*, 70*b*) to engage with each adjuster (e.g. 117, 119) and counterpart adjuster (e.g. 217, 219) in turn so that the adjusters (e.g. 117, 119) and counterpart adjusters (e.g. 217, 219) can be rotated to adjust the clamping arms (e.g. 101, 103) and counterpart clamping arms (e.g. 201, 203). The clamping arms (e.g. 101, 103) and counterpart clamping arms (e.g. 201, 203) can thus engage with the respective attachment beams 20*a*, 20*b*.

Figure 12:
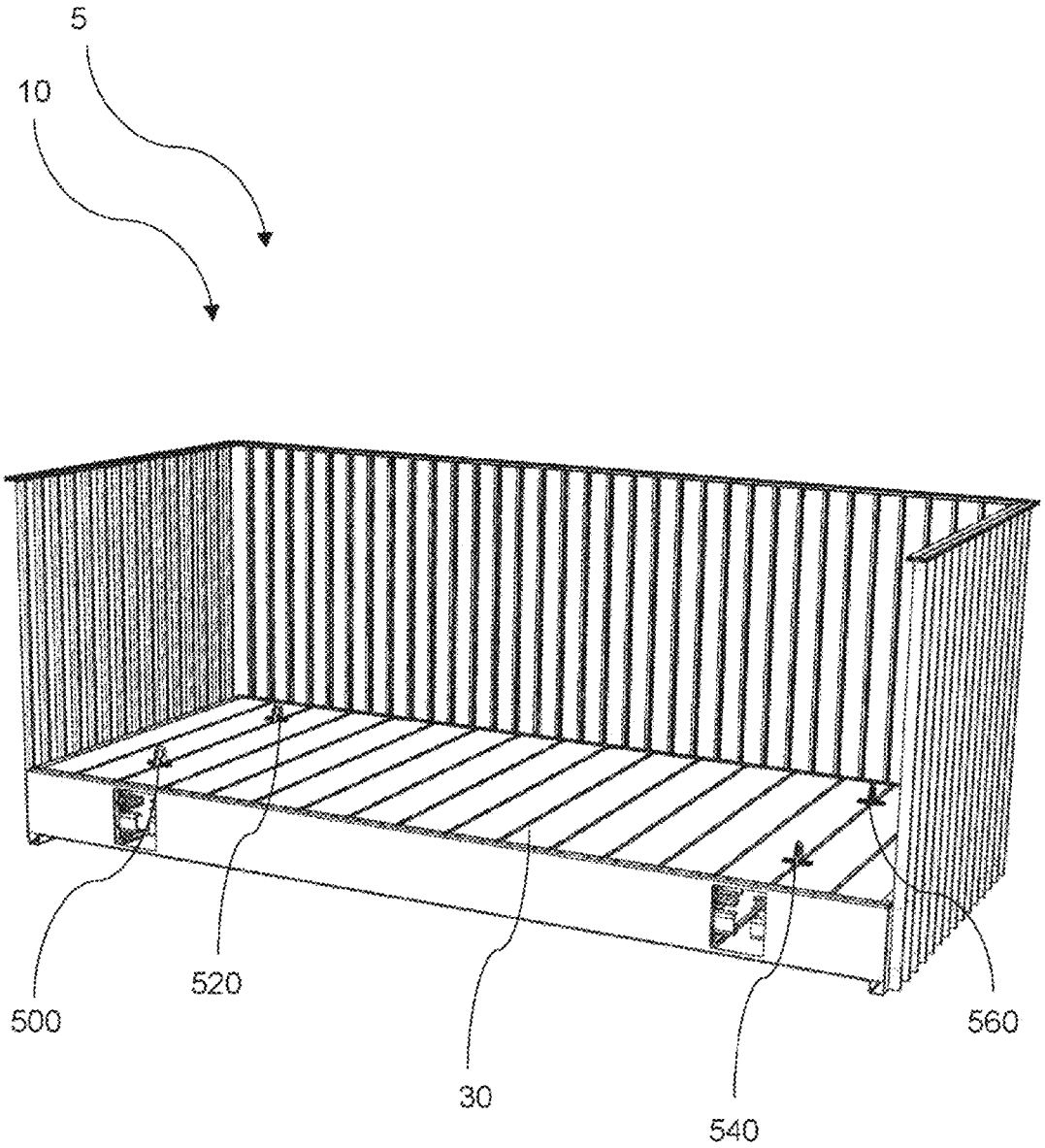
FIG. 12 is a perspective view of a balcony system according to the first embodiment which comprises the balcony shown in FIG. 1.

FIG. 12 shows a perspective view of a balcony system 5 comprising the balcony 10 which is described previously and four identical hooks 500, 520, 540, 560. Respective apertures in the floor (the apertures being identical to the example apertures 70*a*, 70*b* described above) are configured to receive the four hooks 500, 520, 540, 560. Each of the four hooks 500, 520, 540, 560 are configured to hook onto respective hooking anchors (not visible in FIG. 12) located below the floor 30 to allow the balcony 10 to be lifted by the hooks 500, 520, 540, 560. Accordingly, the hooking anchors are aligned with respective apertures.

The hooking anchors are arranged in a grid aligned in the balcony width direction and the balcony projection direction. This means that when the hooks 500, 520, 540, 560 are attached to the respective hooking anchors, the hooks 500, 520, 540, 560 are arranged in a grid aligned in the balcony width direction and the balcony projection direction.

Figure 13:
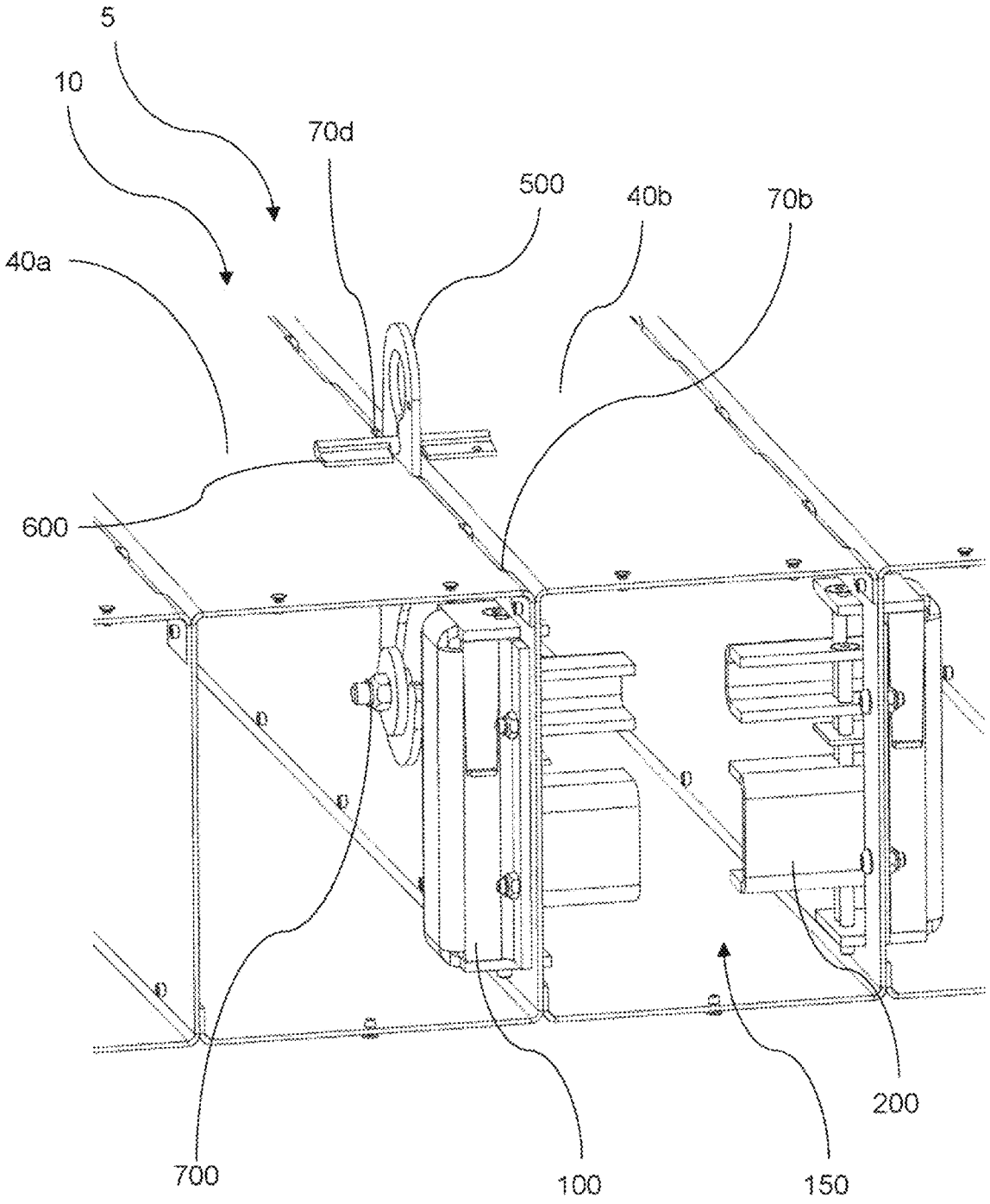
FIG. 13 is a partial perspective view of the balcony system in FIG. 12 wherein the frame has been completely removed.

As an example of the hooks 500, 520, 540, 560 and the hooking anchors, FIG. 13 is a partial perspective view of the balcony system 5, showing rafters 40*a* and 40*b* described above. Aperture 70*b* which allows access to the adjusters 117, 119 of the clamping mechanism 100 is also shown. Additionally, FIG. 13 shows aperture 70*d*, which is identical to aperture 70*b*. Aperture 70*d* is configured to receive the hook 500 so that the hook 500 is capable of being hooked onto the hooking anchor 700 which is vertically aligned with (i.e. directly below) the aperture 70*d*. The hook 500 is also held in place by the locking key 600. The other hooks 520, 540, 560 also have a corresponding locking keys identical to the locking key 600 and corresponding hooking anchors similar to hooking anchor 700, which are not shown in detail for brevity. Like all apertures in the floor 30, the aperture 70*d* is a drainage weep aperture which functions as such when the hook 500 is removed (all hooks 500, 520, 540, 560) are removed when the balcony 10 is installed as shown in FIG. 2).

Figure 14:
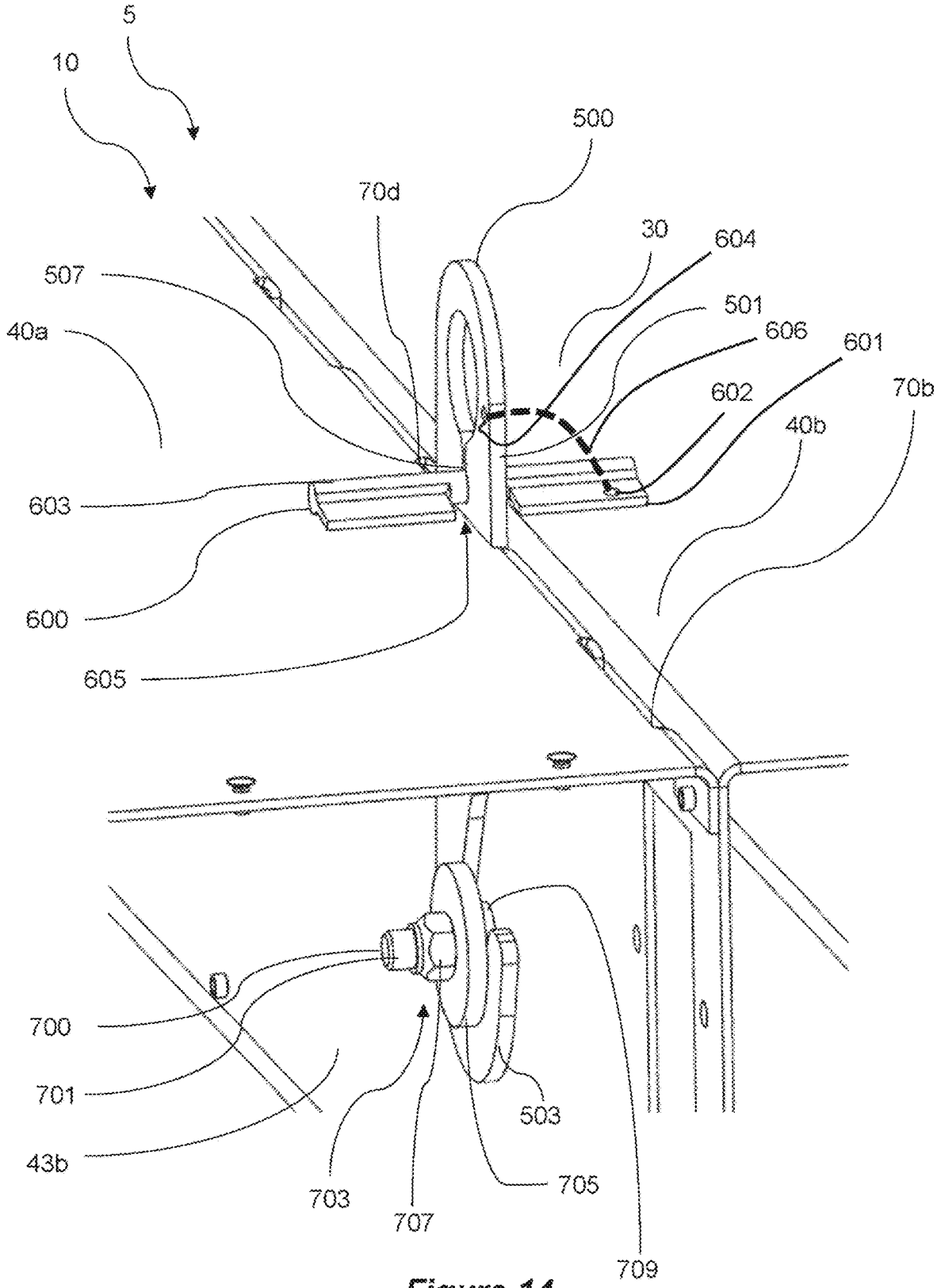
FIG. 14 is a partial perspective view which is a close-up view of FIG. 13 wherein the clamping set is also removed.

FIG. 14 shows a close up view of FIG. 13 with the clamping set 150 removed for simplicity. The hooking anchor 700 is attached to the strengthening portion 43*b* of the rafter 40*b*. Specifically, a threaded cap screw 701 passes through a hole (not visible) in the strengthening portion 43*b* in a direction perpendicular to the length of the strengthening portion 43*b*. The threaded shaft of the cap screw 701 has a shaft diameter.

The hooking anchor 700 has a lateral constraint 703 which is concentric with and fixed to the cap screw 701. The lateral constraint 703 comprises a washer 705 and a lock nut 707. The diameter of the lock nut 707 and the diameter of the washer 705 are larger than the shaft diameter). The lateral constraint 703 is spaced from the strengthening portion 43*b* of the rafter 40*b* by a spacer 709. The spacer 709 is concentric with the cap screw 701.

When hooked onto the hooking anchor 700, the hook may be laterally constrained between the lateral constraint 703 and the corresponding strengthening portion 43*b* of the rafter 40*b*. The spacer 709 has a spacer diameter which is greater than the shaft diameter and smaller than the diameter of the washer 705. The spacer 709 is also a washer.

The hook 500 is able to hook onto the hooking anchor 700 at the spacer 709 and is laterally constrained between the washer 705 of the lateral constraint 703 and the strengthening potion 43*b*.

Figure 15:
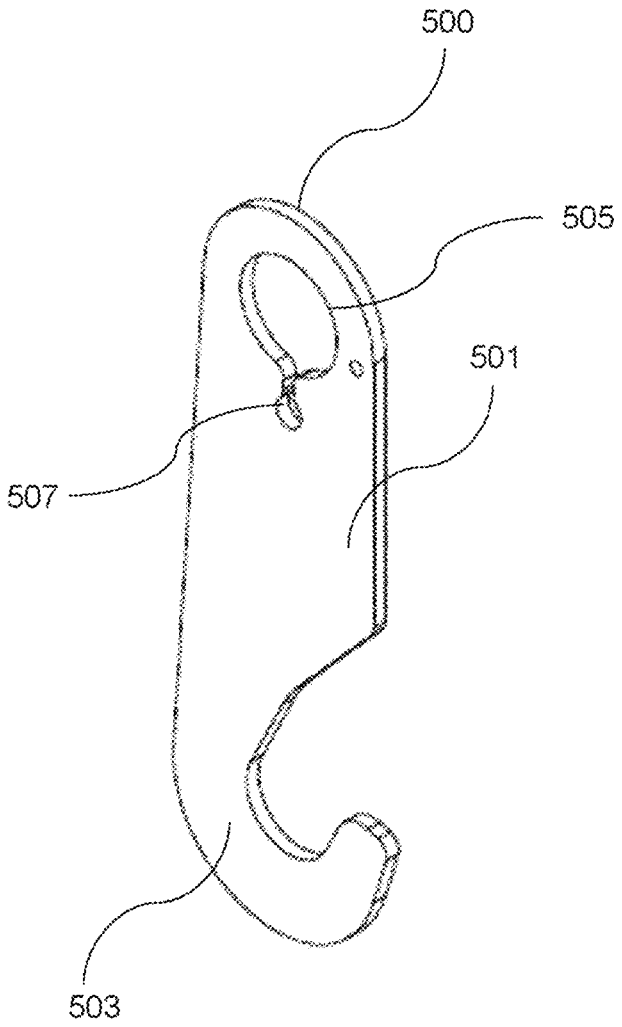
FIG. 15 is a perspective view of a hook, the hook being part of the balcony system according to the first embodiment.

FIG. 15 shows a perspective view of the hook 500, which is substantially identical to the other hooks 520, 540, 560. The hook 500 comprises a stem 501 which extends in a longitudinal direction (upwards in FIG. 15) away from a curved crook portion 503. The curved crook portion 503 is configured to engage with the hooking anchor 700 (shown in FIG. 14). The transverse cross-sectional area (perpendicular to the longitudinal direction) of the hook 500 is smaller than the cross-sectional area of the aperture 70*d* (shown in FIG. 14) so that the hook 500 can be received in the aperture 70*d*. The stem 501 comprises an eyelet 505 which extends through the stem 501 perpendicularly to the longitudinal direction. As shown in FIG. 12, FIG. 13 and FIG. 14, the eyelet protrudes above the floor 30 of the balcony 10 when the hook 500 is hooked onto the hooking anchor 700. The eyelet 505 is used to attach lifting equipment to the hook. The thickness of the hook (in the direction perpendicular to the longitudinal direction) is configured to fit between the lateral constraint 703 and the strengthening portion 43*b* when the hook 500 is hooked onto the hooking anchor 700 (best shown in FIG. 14). The hook 500 comprises a keyhole 507 in the stem 501. The keyhole 507 is merged with the eyelet 505 to form a single aperture through the stem 501 of the hook 500. The locking key 600 is configure to be received in the keyhole 507.

Referring to FIG. 14, when the hook 500 is hooked onto the hooking anchor 700, the locking key 600 is passed through the keyhole 507 and moved to a locking position (the position of the locking key 600 in FIG. 14) to prevent vertical movement of the hook 500 relative to the balcony 10. The hook 500 is effectively constrained between the locking key 600 and the hooking anchor 700.

The locking key 600 is rotated from an insertion position (not shown) to the locking position (shown in FIG. 14). In the insertion position the shape of the locking key 600 aligns with the shape of the keyhole 507. The locking key 600 comprises a key bit 601 which, in the locking position, makes contact with the floor 30 of the balcony 10 to prevent vertical movement of the hook 500 relative to the balcony 10.

The key bit 601 is located on a key shaft 603 and extends along the length of the key shaft 603. In the insertion position, the key bit 601 and the key shaft 603 are aligned with the keyhole 507. The key bit 601 comprises a key recess 605 such that the key bit 601 extends from opposite sides of the key recess 605 along the length of the key shaft 603. In the locking position, the key recess 605 aligns with the stem 501 of the hook 500 and part of the stem 501 of the hook 500 is received in the key recess 605. To achieve this, an internal dimension of the key recess 605 along the length of the key shaft 603 is greater than the thickness of the hook 500.

Key bit 601 has a retainer hole 602. The hook has a corresponding retainer hole 604. Attached to retainer hole 602 and retainer hole 604 is a corresponding retainer cable 606, shown in thick dotted line in the drawing. This retainer cable serves to keep the key 600 and the hook 500 together when the key (at least) is not in use).

In order to lift the balcony 10, the hook 500 is received in the aperture 70*d* and is hooked onto the hooking anchor 700. The locking key 600 is inserted into the hook 500 (in the insertion position) and rotated to the locking position. Thus the hook 500 is held in position. A similar process is performed for the other hooks 520, 540, 560 so that all the hooks 500, 520, 540, 560 are hooked onto a corresponding hooking anchor (e.g. 700) and held in place by a corresponding locking key (e.g. 600). Lifting equipment is attached to the eyelets (e.g. 505) of each hook 500, 520, 540, 560 and the balcony 10 is lifted and located on the attachment beams 20*a*, 20*b* as shown in FIG. 2. The balcony 10 can be secured to the attachment beams 20*a*, 20*b* as described above. The locking keys (e.g. 600) are then removed from the hooks 500, 520, 540, 560 and the hooks 500, 520, 540, 560 are unhooked from the hooking anchors (e.g. 700) and removed from the apertures (e.g. 70*d*).

Figure 16:
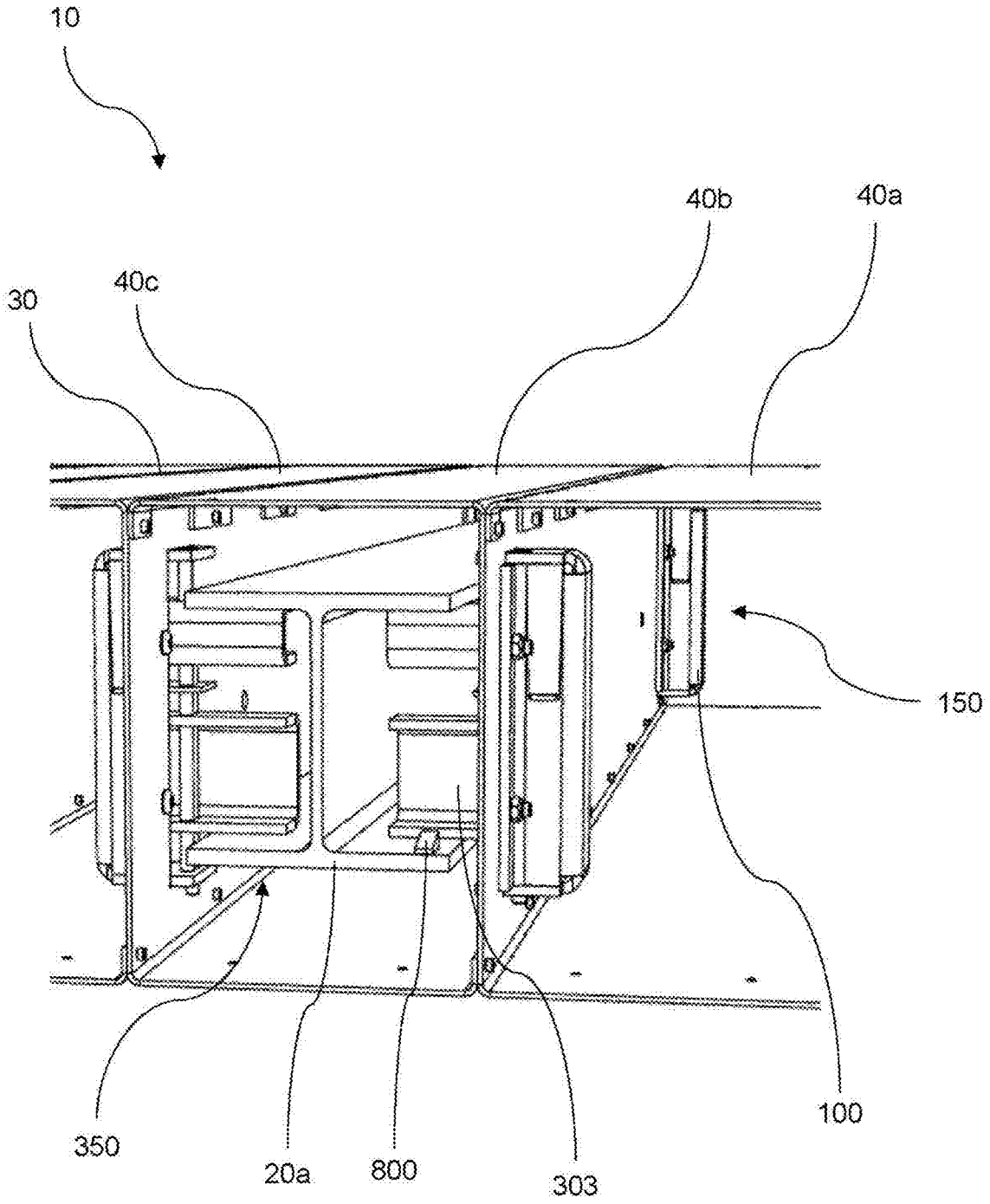
FIG. 16 is a perspective view of the front of the balcony according to the first embodiment wherein the frame is removed.

FIG. 16 shows a perspective view of the front of the balcony 10 with the front part of the frame 15 removed such that the clamping set 350 is exposed. For context, the clamping mechanism 100 discussed previously is at the back of the balcony 10 in FIG. 16. The attachment beam 20*a* extends through the balcony 10 and the balcony is attached to the attachment beam 20*a* as described above via the clamping sets 150, 350. FIG. 16 shows that the attachment beam 20*a* comprises a stopper 800.

Figure 17:
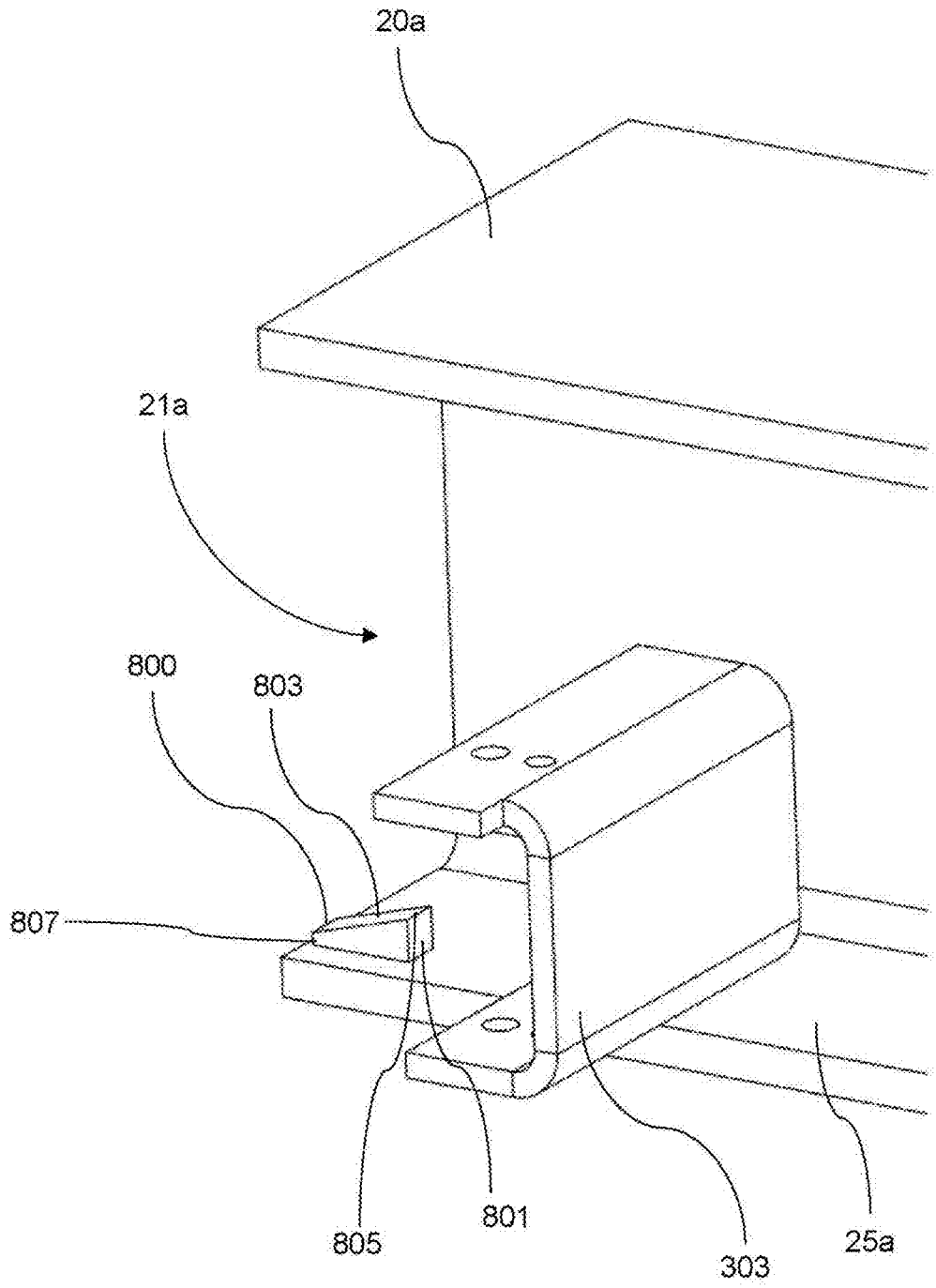
FIG. 17 is a detail perspective view of a stopper on an attachment beam wherein the only visible component of a clamping set attached to the balcony of the first embodiment is a clamping arm.

FIG. 17 shows a close-up perspective view of the stopper 800 on the attachment beam 20*a* from a different direction to FIG. 16. In FIG. 17, all components of the clamping set 350 except the clamping arm 303 (which is identical to clamping arm 103 described above) have been removed for clarity.

Best shown in FIG. 17, the stopper 800 comprises a stopping face 801, facing the building end of the attachment beam 20*a*. The stopping face 801 is aligned with the clamping arm 303 (also known as the stopper engaging portion). Thus the stopping face 801 is configured to abut the clamping arm 303 if the balcony 10 comprising the clamping arm 303 were to slide away from the building (i.e. in FIG. 17, the balcony sliding away from the building would cause the clamping arm 303 to slide along the attachment beam 20*a* to the left).

The stopper 800 is located on the second surface 25*a* of the lateral recess 21*a* (see also FIG. 6) which faces upwards such that the stopping face 801 extends away from the second surface 25*a*. The stopping surface 801 is a flat surface.

The stopper also comprises a sloping face 803 which is spaced from the second surface 25*a* and on the side of the stopping face 801 furthest from the building. The sloping face 803 extends away from the building (i.e. away to the left in FIG. 17) and towards the second surface 25*a* of the attachment beam 20*a* (i.e. the sloping face 803 slopes downwards). The sloping face 803 extends from an edge 805 of the stopper 800 which is spaced furthest from the second surface 25*a*. The sloping face 803 is spaced from the second surface 25*a* at an end distant from the stopping face 801 by a spacing face 807. The sloping face 803 has a constant gradient such that the stopper 800 resembles a partial wedge. The sloping face 803 allows the balcony 10 to be slid over the stopping face 801 when the balcony 10 is installed on the building. The stopper 800 is proximate an end of the attachment beam 20*a* distant from the building.

As shown in FIG. 2, the balcony 10 is attached to two attachment beams 20*a*, 20*b*. The attachment beam 20*b* also comprises a stopper in a substantially identical arrangement to the stopper 800 on attachment beam 20*a*. A description of attachment beam 20*b* comprising a stopper is omitted for brevity.

The balcony 10 is installed on the attachment beams 20*a*, 20*b* by sliding the balcony towards the building and over the respective stoppers (e.g. 800). The balcony 10 is then secured to the attachment beams 20*a*, 20*b* as described above so that the stopping face (e.g. 801) is aligned with a clamping arm (e.g. 303). If the balcony 10 were to slide away from the building, the stoppers (e.g. 800) abut the respective clamping arms (e.g. 303) and prevent the balcony slidably detaching from the building.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

The invention claimed is:

1. A balcony attachable to an attachment beam extending from a building in order to attach the balcony with respect to the building, the balcony comprising:

a floor which provides a safe, usable surface for an end-user of the balcony to stand on;

a base below the floor; and a plurality of rafters each comprising:

a floor portion which defines a part of the floor, a strengthening portion which is located below the floor portion and extends downwardly from the floor portion, and a base portion which defines a part of the base and which is connected to the strengthening portion, wherein the floor portions of the rafters cooperate to define the floor and the base portions cooperate to define the base which is spaced from the floor by the strengthening portions of the plurality of rafters, wherein each of the plurality of rafters is an integrally formed component in which the base portion is integrally formed with the strengthening portion and the floor portion, wherein each of the plurality of rafters is a folded metal sheet having a first fold line between the floor portion and the strengthening portion and a second fold line between the base portion and the strengthening portion, wherein the floor portion includes a downwardly oriented floor portion lip for attachment to a strengthening portion of a first adjacent rafter, and wherein the base portion includes an upwardly oriented base portion lip for attachment to a strengthening portion of one of the first adjacent rafter or a second adjacent rafter.

2. The balcony according to claim 1 wherein each floor portion of the plurality of rafters is in abutment with adjacent floor portions.

3. The balcony according to claim 1 wherein each base portion of the plurality of rafters is in abutment with adjacent base portions.

4. The balcony according to claim 1 wherein the floor portion of each rafter each have a length, a width and a thickness, the width and the thickness are smaller than the length and the thickness is smaller than the width and wherein a surface of the floor portion having a length and a width defines a part of an upper surface of the floor.

5. The balcony according to claim 4 wherein the strengthening portion of each rafter has a length, a depth and a thickness, the depth and the thickness are smaller than the length and the thickness is a smaller than the depth and wherein the lengths of the floor portion and the strengthening portion are parallel and wherein the strengthening portion is rotated relative to the floor portion by an angle about an axis parallel to the length of the strengthening portion such that the strengthening portion is a web extending from the floor portion.

6. The balcony according to claim 5 wherein the angle is about 90 degrees.

7. The balcony according to claim 4 wherein the base portion of each rafter has a length, a width and a thickness, the width and the thickness are smaller than the length and the thickness is smaller than the width and wherein the length of the base portion is parallel to the length of the floor portion and wherein the base portion is in the same orientation as the floor portion.

8. The balcony according to claim 7 wherein the base portion and the floor portion of each of the plurality of rafters are laterally offset from each other in a direction parallel to the width of the floor portion.

9. The balcony according to claim 8 wherein the floor portion of each rafter is directly above the base portion of a first adjacent rafter and the base portion of each rafter is directly below the floor portion of a second adjacent rafter on a side opposite the first adjacent rafter.

10. The balcony according to claim 1, wherein the floor comprises a plurality of apertures which are configured to allow drainage and permit access below the floor.

11. The balcony according to claim 10 wherein the apertures are located adjacent to respective fold lines between the floor portion and the strengthening portion of one or more rafters.

12. The balcony according to claim 1, wherein the base comprises a fall angle relative to the floor.

13. The balcony according to claim 12 wherein a depth of the strengthening portion of each rafter varies along a length of the strengthening portion to define the fall angle of the base.

14. The balcony according to claim 1 wherein the downwardly oriented floor portion lip is for attachment to the strengthening portion of the first adjacent rafter, and the upwardly oriented base portion lip is for attachment to the strengthening portion of the second adjacent rafter, different than the first adjacent rafter.

15. The balcony according to claim 1 wherein the downwardly oriented floor portion lip is for attachment to the strengthening portion of the first adjacent rafter, and the upwardly oriented base portion lip is for attachment to the strengthening portion of the first adjacent rafter.

16. A building comprising:

a balcony comprising:

a floor which provides a safe, usable surface for an end-user of the balcony to stand on;

a base below the floor; and a plurality of rafters each comprising:

a floor portion which defines a part of the floor, a strengthening portion which is located below the floor portion and extends downwardly from the floor portion, wherein the floor portions of the rafters cooperate to define the floor and the base portions cooperate to define the base which is spaced from the floor by the strengthening portions of the plurality of rafters, and wherein each of the plurality of rafters is an integrally formed component in which the base portion is integrally formed with the strengthening portion and the floor portion;

wherein each of the plurality of rafters is a folded metal sheet having a first fold line between the floor portion and the strengthening portion and a second fold line between the base portion and the strengthening portion, wherein the floor portion includes a downwardly oriented floor portion lip for attachment to a strengthening portion of a first adjacent rafter, and wherein the base portion includes an upwardly oriented base portion lip for attachment to a strengthening portion of one of the first adjacent rafter or a second adjacent rafter;

the building further including one or more attachment beams which support the balcony.

* * * * *